US009086078B2

(12) United States Patent
Nakayama et al.

(10) Patent No.: US 9,086,078 B2
(45) Date of Patent: Jul. 21, 2015

(54) STATIONARY VANE UNIT OF ROTARY MACHINE, METHOD OF PRODUCING THE SAME, AND METHOD OF CONNECTING THE SAME

(75) Inventors: Takeki Nakayama, Tokyo (JP); Yuki Yamamoto, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 791 days.

(21) Appl. No.: 13/283,850

(22) Filed: Oct. 28, 2011

(65) Prior Publication Data

US 2012/0219412 A1 Aug. 30, 2012

(30) Foreign Application Priority Data

Feb. 28, 2011 (JP) ..... 2011-042310

(51) Int. Cl.

| | |
|---|---|
| ***F04D 9/04*** | (2006.01) |
| ***F04D 29/54*** | (2006.01) |
| ***F01D 25/24*** | (2006.01) |
| ***F01D 9/04*** | (2006.01) |

(52) U.S. Cl.

CPC ..... *F04D 29/542* (2013.01); *F01D 9/042* (2013.01); *F01D 25/243* (2013.01); *F01D 25/246* (2013.01); *F05D 2220/31* (2013.01); *F05D 2260/31* (2013.01); *F05D 2260/37* (2013.01); *Y10T 29/49323* (2015.01)

(58) Field of Classification Search

CPC ..... F01D 9/042; F01D 25/246; F04D 29/542
USPC ..... 415/189, 190, 209.3, 209.4; 416/215, 416/204 A

See application file for complete search history.

(56) References Cited

U.S. PATENT DOCUMENTS

| | | | |
|---|---|---|---|
| 1,998,951 | A | 4/1935 | Downer |
| 2,220,914 | A | 11/1940 | Robinson |

(Continued)

FOREIGN PATENT DOCUMENTS

| | | |
|---|---|---|
| CN | 1041810 | 5/1990 |
| CN | 1621661 | 6/2005 |

(Continued)

OTHER PUBLICATIONS

International Search Report issued Dec. 20, 2011 in International (PCT) Application No. PCT/JP2011/075058 with English Translation.

(Continued)

*Primary Examiner* — Nathaniel Wiehe
*Assistant Examiner* — Kayla McCaffrey
(74) *Attorney, Agent, or Firm* — Wenderoth, Lind & Ponack, L.L.P.

(57) ABSTRACT

The stationary vane unit of a rotary machine includes: a first band member that extends in the circumferential direction and comes into contact with the outer shrouds of the plurality of stationary vane members from one side thereof in the main axial direction in which a central axis extends; a second band member that extends in the circumferential direction and comes into contact with the outer shrouds of the plurality of stationary vane members from the other side thereof in the main axial direction; and a fastening member that fastens the first band member and the second band member to each other so that the outer shrouds of the plurality of stationary vane members are connected to each other.

20 Claims, 18 Drawing Sheets

(56) References Cited

U.S. PATENT DOCUMENTS

| | | | | |
|---|---|---|---|---|
| 2,326,145 | A * | 8/1943 | Kroon | 416/217 |
| 2,445,661 | A | 7/1948 | Constant et al. | |
| 2,996,279 | A | 8/1961 | Lorett et al. | |
| 3,300,180 | A | 1/1967 | Tuttle | |
| 4,039,872 | A | 8/1977 | Armor et al. | |
| 5,441,385 | A | 8/1995 | Boyd et al. | |
| 5,554,001 | A * | 9/1996 | Boyd et al. | 415/209.2 |
| 5,591,003 | A | 1/1997 | Boyd et al. | |
| 5,743,711 | A | 4/1998 | Fournier et al. | |
| 7,618,234 | B2 * | 11/2009 | Brackett et al. | 415/119 |
| 7,758,314 | B2 * | 7/2010 | Wilson et al. | 416/226 |
| 2007/0177973 | A1 * | 8/2007 | Seki et al. | 415/191 |
| 2008/0170939 | A1 * | 7/2008 | Palmer et al. | 415/209.2 |

FOREIGN PATENT DOCUMENTS

| | | |
|---|---|---|
| CN | 101652534 | 2/2010 |
| DE | 461 307 | 6/1928 |
| JP | 2006-250147 | 9/2006 |
| JP | 2009-002338 | 1/2009 |
| JP | 2009-097370 | 5/2009 |
| JP | 2010-151044 | 7/2010 |

OTHER PUBLICATIONS

Written Opinion of the International Searching Authority issued Dec. 20, 2011 in International (PCT) Application No. PCT/JP2011/075058 with English Translation.

Office Action issued Aug. 26, 2014 in corresponding Chinese patent application No. 201180052476.4 (with English translation of Search Report).

Extended European Search Report issued Sep. 30, 2014 in corresponding European patent application No. 11859690.7.

* cited by examiner

STATIONARY VANE UNIT OF ROTARY MACHINE, METHOD OF PRODUCING THE SAME, AND METHOD OF CONNECTING THE SAME

BACKGROUND OF THE INVENTION

1. Field of the Invention

The present invention relates to a stationary vane unit of a rotary machine, a method of producing the stationary vane unit of the rotary machine, and a method of connecting the stationary vane unit of the rotary machine.

Priority is claimed on Japanese Patent Application No. 2011-042310, filed on Feb. 28, 2011, the content of which is incorporated herein by reference.

2. Description of the Related Art

Hitherto, for example, in a rotary machine such as a compressor and a turbine of a gas turbine, or a steam turbine and so on, a structure is known in which a stationary vane unit is disposed in the inner periphery of a casing extending along the outer periphery of a rotor. In the stationary vane unit, a plurality of stationary vane members is arranged around a central axis of rotation of the rotor for rotary machine, and outer shrouds formed in the outer peripheries of the stationary vane members are continuous in the circumferential direction so as to be connected to each other. As such a stationary vane unit, for example, as disclosed in JP-A-2009-2338, the outer shrouds connected to each other in an annular shape are connected to inner shrouds by welding, so that the plurality of stationary vane members is integrated with each other.

However, when the plurality of stationary vane members is integrated with each other by welding as described above, a large amount of welding heat is input to the outer shroud and the stationary vane body, so that they are thermally deformed. In order to prevent such adverse effect, in JP-A-2009-97370, a connection member which extends in the circumferential direction is provided along the outer peripheries of the outer shrouds connected to each other in the annular shape, and the connection member and the outer shrouds are welded to each other, so that the heat input to the outer shrouds and the stationary vane body is suppressed.

PRIOR TECHNICAL DOCUMENTS

[Patent Document 1] Japanese Published Unexamined Patent Application No. 2009-2338

[Patent Document 2] Japanese Published Unexamined Patent Application No. 2009-97370

BRIEF SUMMARY OF THE INVENTION

In the related arts, the heat input to the outer shroud is suppressed by interposing the connection member. However, there is no change in the fact that the plurality of stationary vane members is connected to each other by welding, and the thermal deformation may occur due to the heat input. As a result, there is a problem in that the precision with respect to the design value is degraded.

The invention is made in view of such circumstances, and the object of the invention is to provide a stationary vane unit with high precision with respect to the design value.

According to an aspect of the invention, there is provided a stationary vane unit of a rotary machine in which a plurality of stationary vane members is arranged around a central axis and outer shrouds formed in the outer peripheries of the stationary vane members are continuous in the circumferential direction so as to be connected to each other, the stationary vane unit including: a first band member that extends in the circumferential direction and comes into contact with the outer shrouds of the plurality of stationary vane members from one side thereof in the main axial direction in which a central axis extends; a second band member that extends in the circumferential direction and comes into contact with the outer shrouds of the plurality of stationary vane members from the other side thereof in the main axial direction; and a fastening member that fastens the first band member and the second band member to each other so that the outer shrouds of the plurality of stationary vane members are connected to each other.

In this way, since the first band member and the second band member are fastened to each other so that the outer shrouds of the plurality of stationary vane members are connected to each other, there is no need to perform welding for the connection of the stationary vane members. Accordingly, since the stationary vane members may be prevented from being thermally deformed during the process of assembling the stationary vane members, the assembly precision may be improved. Thus, the stationary vane unit with high precision with respect to the design value may be obtained.

Further, at least one of the first band member and the second band member may be fitted to the outer shrouds of the plurality of stationary vane members.

In this way, at least one of the first band member and the second band member is fitted to the outer shrouds of the plurality of stationary vane member. For this reason, a positional deviation of the first band member or the second band member fitted to the outer shroud with respect to the outer shroud may be suppressed, and the precision with respect to the design value may be further improved.

Further, the fastening member may penetrate the outer shrouds in the main axial direction.

In this way, since the fastening member penetrates the outer shroud in the main axial direction, the fastening member is positioned inside the stationary vane unit. Accordingly, since the fastening member does not protrude outward from the stationary vane unit, the configuration may be made compact.

Further, a plurality of the fastening members may be provided at intervals in the circumferential direction, and at least one stationary vane member may be positioned between two fastening members which make a pair and are adjacent to each other in the circumferential direction when seen from the main axial direction.

In this way, since at least one stationary vane member is positioned between two fastening members, at least two or more stationary vane members may be fastened to each other by two fastening members. Accordingly, since the number of the fastening members decreases compared to the number of the stationary vane members, the number of components may be reduced.

Further, at least one of the first band member and the second band member may be formed in an annular shape.

In this way, since at least one of the first band member and the second band member is formed in an annular shape, the structure is stable and the rigidity improves. Accordingly, since the deformation is suppressed, the precision with respect to the design value may be improved.

Further, at least one of the first band member and the second band member may be formed in an annular shape and be divided into multiple circular-arc-band-like bodies.

In this way, since at least one of the first band member and the second band member is divided into multiple circular-arc-band-like bodies, the manufacturing tolerance may be adjusted by adjusting the positions of the circular-arc-band-like bodies.

Further, at least one of the first band member and the second band member may be buried in the outer shroud of the stationary vane member, and may include a crushed portion which is plastically deformed toward the outer shroud.

In this way, since at least one of the first band member and the second band member includes the crushed portion, the crushed portion comes into close contact with the outer shroud in a manner such that the first band member or the second band member provided with the crushed portion is relatively displaced toward the outer shroud. Accordingly, the insufficient fitting between the second band member and the outer shroud may be suppressed.

Further, the outer shroud may include a penetration portion through which the fastening member passes and which extends from one side of the circumferential direction toward the other side thereof.

In this way, the penetration position of the fastening member may be minutely adjusted in the circumferential direction during the assembly. Accordingly, since the ease of the assembly improves, the assembly work may be performed in a short amount of time.

Further, according to another aspect of invention, there is provided a method of producing a stationary vane unit of a rotary machine in which a plurality of stationary vane members is arranged around a central axis and outer shrouds formed in the outer peripheries of the stationary vane members are continuous in the circumferential direction so as to be connected to each other, the method including: a preparing step preparing the plurality of stationary vane members, a first band member which extends in the circumferential direction and is connected with one end portions of the outer shrouds from one side of the main axial direction in which the central axis extends, and a second band member which extends in the circumferential direction around the central axis and is connected with the other end portions of the outer shrouds from the other side of the main axial direction; an arranging step arranging the plurality of stationary vane members in the circumferential direction while one end portions of the outer shrouds of the stationary vane members are fitted to one of the first band member and the second band member placed on a work support surface; a fitting step fitting the other of the first band member and the second band member to the other end portions of the plurality of outer shrouds continuous in the circumferential direction; and a fastening step fastening the first band member and the second band member to each other so that the outer shrouds of the plurality of stationary vane members are connected to each other.

In this way, the plurality of stationary vane members may be arranged in the circumferential direction while one end portion of the outer shroud of the stationary vane member is fitted to one of the first band member and the second band member placed on the work support surface. Further, the other of the first band member and the second band member is fitted to the other end portions of the plurality of circumferentially continuous outer shrouds of the plurality of stationary vane members arranged in the circumferential direction. For this reason, the first band member and the second band member may be easily positioned with respect to the outer shroud by the fitting between one end portion and the first band member and the fitting between the other end portion and the second band member. Accordingly, since the workability improves, the stationary vane unit may be easily and highly precisely assembled.

Further, no heat input to the stationary vane member occurs due to the connection of the stationary vane member. Accordingly, since the stationary vane member may be prevented from being thermally deformed during the process of assembling the stationary vane member, the assembly precision may be improved.

Thus, the stationary vane unit with high precision with respect to the design value may be obtained.

Further, in the preparing step, one end portion of the outer shroud of the stationary vane member may be provided with a concave portion, and one of the first band member and the second band member may be provided with a convex portion which includes a base portion extending in the circumferential direction and formed in a flat shape and a reference surface protruding in the perpendicular direction and extending in the circumferential direction. In the fastening step, the convex portion of one of the first band member and the second band member may be fitted to the concave portion of the stationary vane member, and one end portions of the outer shrouds of the stationary vane members may be fastened to the reference surface of one of the first band member and the second band member by the fastening member while being pressed against the reference surface.

In this way, since the first band member and the second band member are fastened to each other while one end portions of the outer shrouds of the stationary vane members are pressed against the reference surface of the convex portion of one of the first band member and the second band member, the first band member may be suppressed from being distorted and bent. Accordingly, a gap may be suppressed from being formed between the first band member and the plurality of stationary vane members, and the stationary vane unit may be assembled with high precision.

Further, a band cutting margin may be provided in advance in at least one of the first band member and the second band member, and the band cutting margin may be cut so as to adjust the size after the fastening step.

In this way, the band cutting margin provided in at least one of the first band member and the second band member is cut and removed. For this reason, even when the first band member and the second band member increase in size so that the torsional rigidity or the bending rigidity improves and hence the assembly precision improves, the stationary vane unit may be suppressed to a predetermined size.

Further, a shroud cutting margin may be provided in advance in the outer shroud of the stationary vane member so as to be continuous to the band cutting margin, and the shroud cutting margin may be cut so as to adjust the size thereof together with the band cutting margin after the fastening step.

In this way, since the shroud cutting margin of the stationary vane member is removed together with the band cutting margin, the removal work may be easily performed.

Further, in the fitting step, at least one of the first band member and the second band member may be buried in the outer shroud of the stationary vane member. After the fastening step, one of the first band member and the second band member buried in the outer shroud may be plastically deformed toward the outer shroud. Accordingly, a gap between one of them buried in the outer shroud and the outer shroud is filled.

In this way, since the gap between at least one of the first band member and the second band member and the outer shroud is filled, the rattling generated between at least one of the first band member and the second band member and the outer shroud may be suppressed.

Further, there is provided a method of connecting the stationary vane unit of the rotary machine in which a plurality of stationary vane members is arranged around a central axis and outer shrouds formed in the outer peripheries of the stationary vane members are continuous in the circumferential direction so as to be connected to each other, the method including: providing a first band member extending in the circumferential direction in the circumferentially continuous outer shrouds of the plurality of stationary vane members from one side in a main axial direction in which the central axis extends; providing a second band member extending in the circumferential direction from the other side in the main axial direction; and fastening the first band member and the second band member to each other so that the outer shrouds of the plurality of stationary vane members are connected to each other.

In this way, since the first band member and the second band member are fastened to each other so that the outer shrouds of the plurality of stationary vane members are connected to each other, there is no need to perform a welding for the connection of the stationary vane members. Accordingly, since the stationary vane members may be prevented from being thermally deformed during the process of assembling the stationary vane members, the assembly precision may be improved. Thus, the stationary vane unit with high precision with respect to the design value may be obtained.

Effects of the Invention

According to the aspect of the invention, the stationary vane unit with high precision with respect to the design value may be obtained.

DETAILED DESCRIPTION OF THE INVENTION

Figure 1:
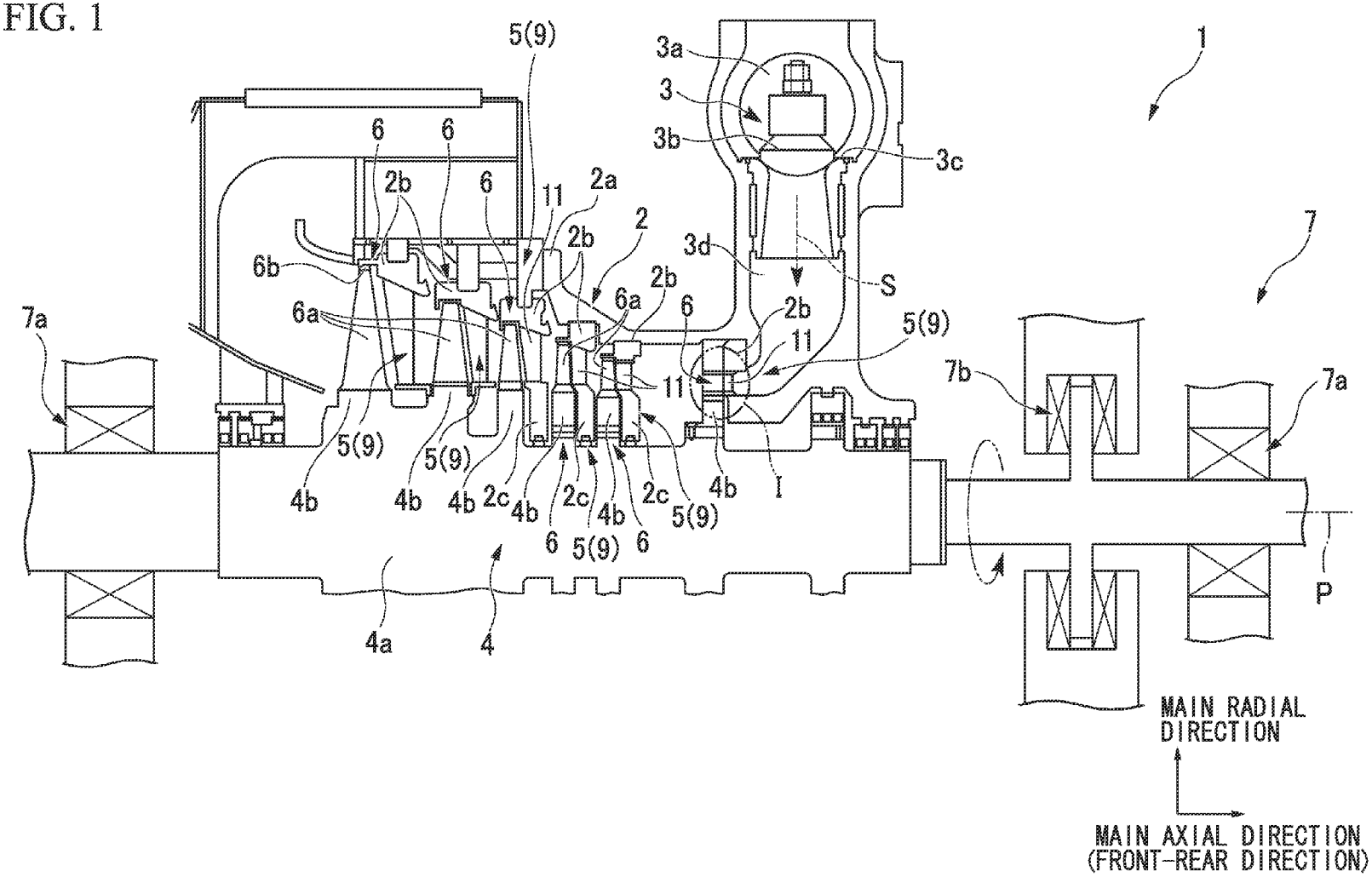
FIG. 1 is a cross-sectional view illustrating the schematic configuration of a steam turbine according to an embodiment of the invention.

Hereinafter, an embodiment of the invention will be described in detail by referring to the drawings.

[Steam Turbine]

FIG. 1 is a cross-sectional view illustrating the schematic configuration of a steam turbine (a rotary machine) 1 according to the embodiment of the invention.

The steam turbine 1 includes a casing 2, an adjusting valve 3, a shaft body 4, a stationary vane row 5, a moving vane row 6, and a bearing portion 7. The adjusting valve 3 adjusts the amount and the pressure of steam S which flows into the casing 2. The shaft body 4 is rotatably provided inside the casing 2, and transmits power to a power transmission subject (for example, a generator) of which power is not shown. The plurality of stationary vane rows 5 is disposed in the inner periphery of the casing 2. The plurality of moving vane rows 6 is disposed in the outer periphery of the shaft body 4. The bearing portion 7 supports the shaft body 4 so as to be rotatable about the shaft.

The casing 2 defines the internal space from the outside, and the internal space is hermetically sealed. The casing 2 extends along the circumference of a rotor R that schematically includes the shaft body 4 and the plurality of moving vane rows 6. The casing 2 includes a case body 2*a*, and an outer race 2*b* which extends along an inner peripheral portion of the casing body 2*a* in the circumferential direction and is fixed to the casing body 2*a*.

Furthermore, in the description below, the direction of the rotation axis of the rotor R is set as the "main axial direction", the circumferential direction of the rotor R is simply set as the "circumferential direction", and the radial direction of the rotor R is set as the "main radial direction".

The adjusting valve 3 includes an adjusting valve chamber 3*a*, a valve body 3*b*, and a valve seat 3*c*. A plurality of the adjusting valve chambers 3*a* is attached to the inside of the casing 2, and the steam S flows from a boiler (not shown) into each of the valve chambers. The valve body 3*b* is displaceable, and the valve body 3*b* is configured to sit on or be separated from the valve seat 3*c*. When the valve body 3*b* moves away from the valve seat 3*c*, the steam passageway is opened, so that the steam S flows into the internal space of the casing 2 through the steam chamber 3*d*.

The shaft body 4 includes a main body 4*a* and a plurality of disks 4*b* which extends from the outer periphery of the main body 4*a* in the radial direction of the shaft body 4. The shaft body 4 transmits rotational energy obtained from the steam S to a power transmission subject (not shown).

In each stationary vane row 5, a plurality of stationary vane bodies 11 is continuous with a gap therebetween. In the stationary vane rows 5, the outer portions thereof in the main radial direction are connected to each other by the outer race 2*b*, and the inner portions thereof are connected to each other by an inner race 2*c*.

In the stationary vane row 5, a plurality of steps is formed with a gap therebetween in the main axial direction, and the steam S is guided to the moving vane row 6 which is adjacent to the downstream.

In the moving vane row 6, a plurality of moving vane bodies 6*a* is continuous in the circumferential direction with a gap therebetween. In the respective moving vane bodies 6*a*, the respective base end sides are supported by the disks 4*b* of the shaft body 4, and tip shrouds 6*b* formed in the respective front ends extend in an annular band shape as a whole.

The moving vane row 6 is disposed at the downstream of each stationary vane row 5, and forms a pair and a stage together with the stationary vane row 5. That is, the steam turbine 1 is configured so that the main stream of the steam S flows alternately between the stationary vane row 5 and the moving vane row 6.

The bearing portion 7 includes a journal bearing device 7*a* and a thrust bearing device 7*b*, and rotatably supports the shaft body 4.

Figure 2:
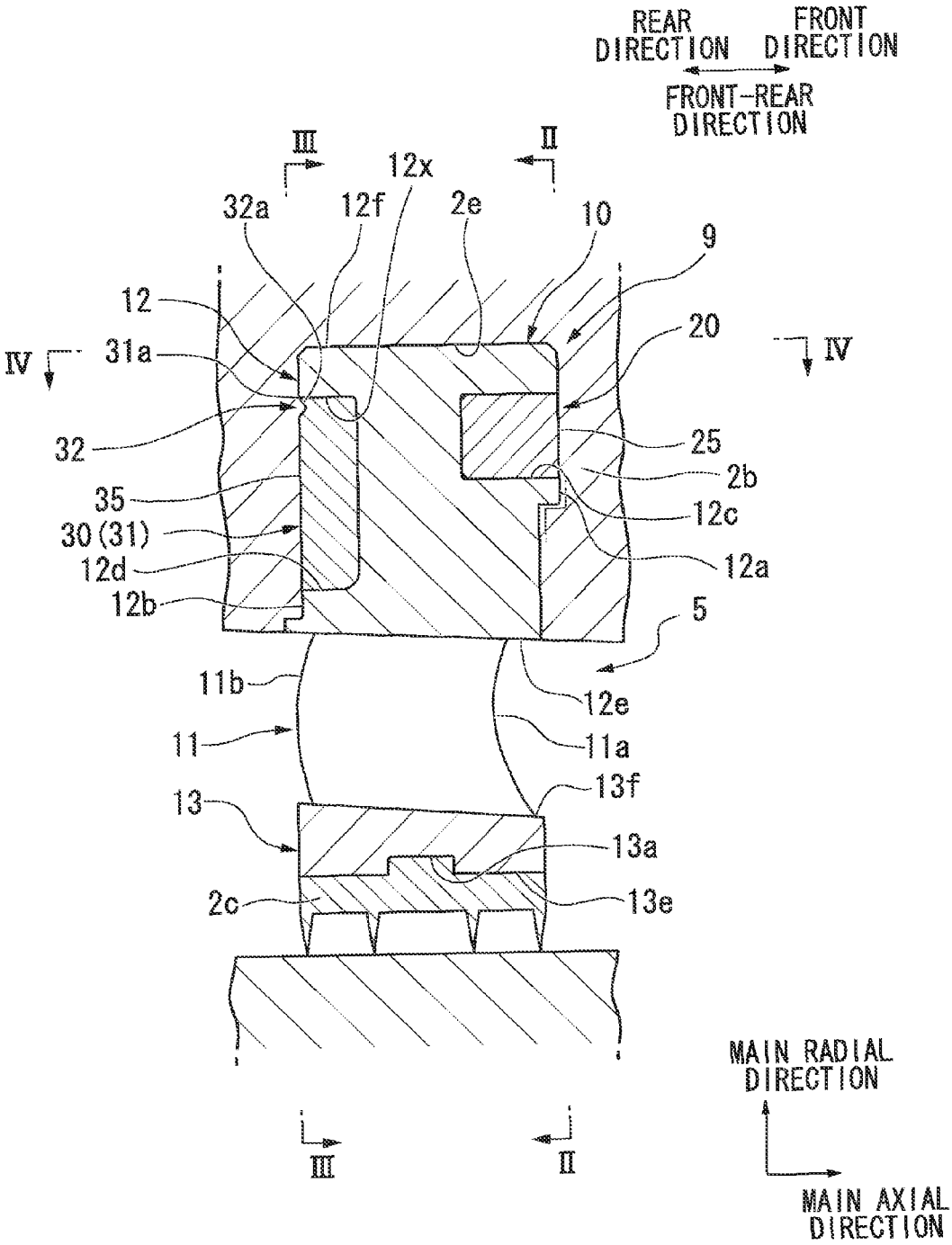
FIG. 2 is an enlarged view illustrating a main part I of FIG. 1 in the embodiment of the invention.

FIG. 2 is an enlarged view illustrating a main part I of FIG. 1.

In each stationary vane row 5 of the above-described steam turbine 1, as shown in FIG. 2, a stationary vane unit 9 is held in an inner circumferential groove 2*e* which extends in the circumferential direction in the inner peripheral portion of the outer race 2*b*.

[Stationary Vane Unit]

Figure 3:
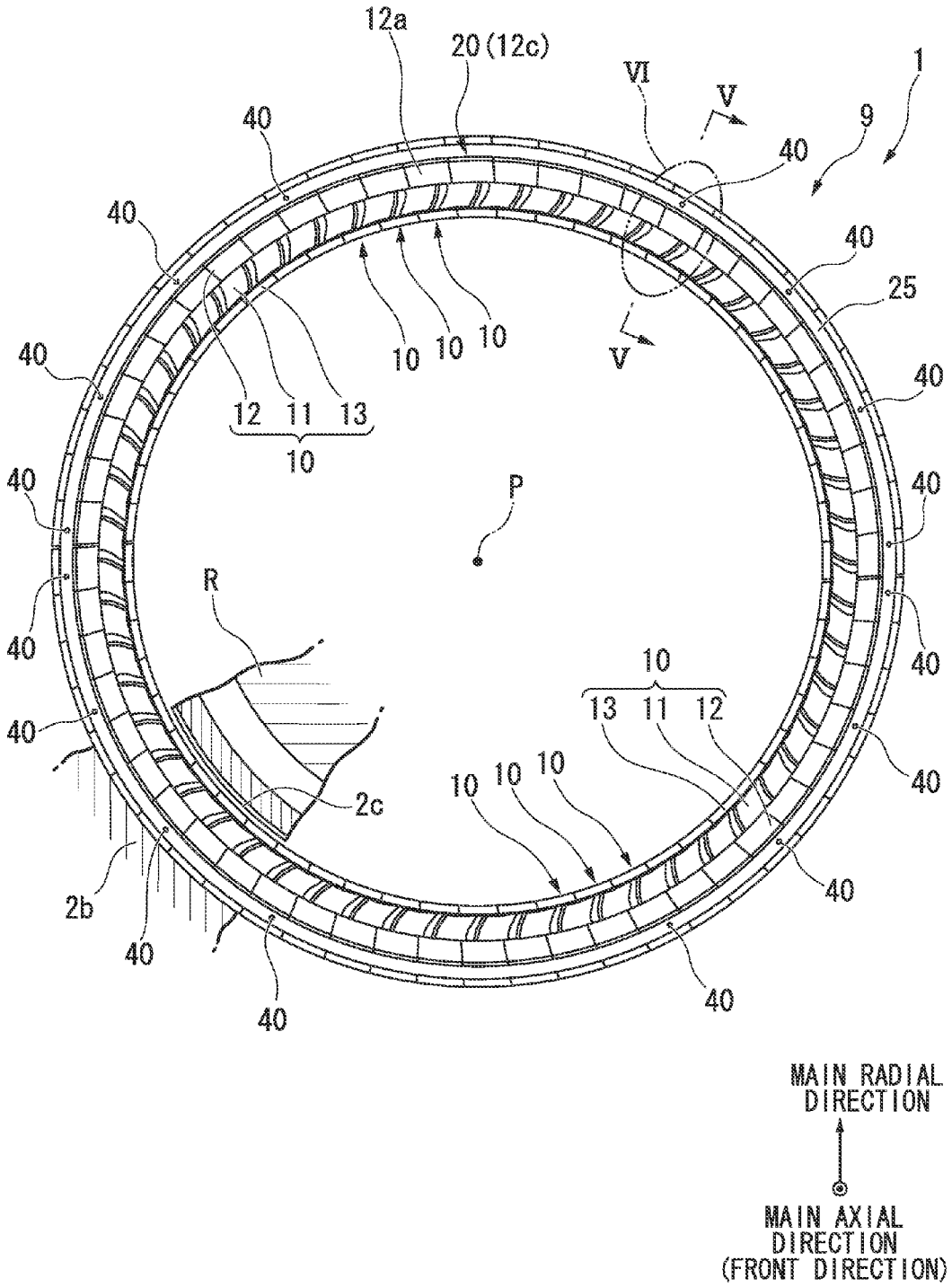
FIG. 3 is a cross-sectional view taken along the line II-II of FIG. 2 in the embodiment of the invention.

FIG. 3 is a cross-sectional view taken along the line II-II of FIG. 2.

Figure 4:
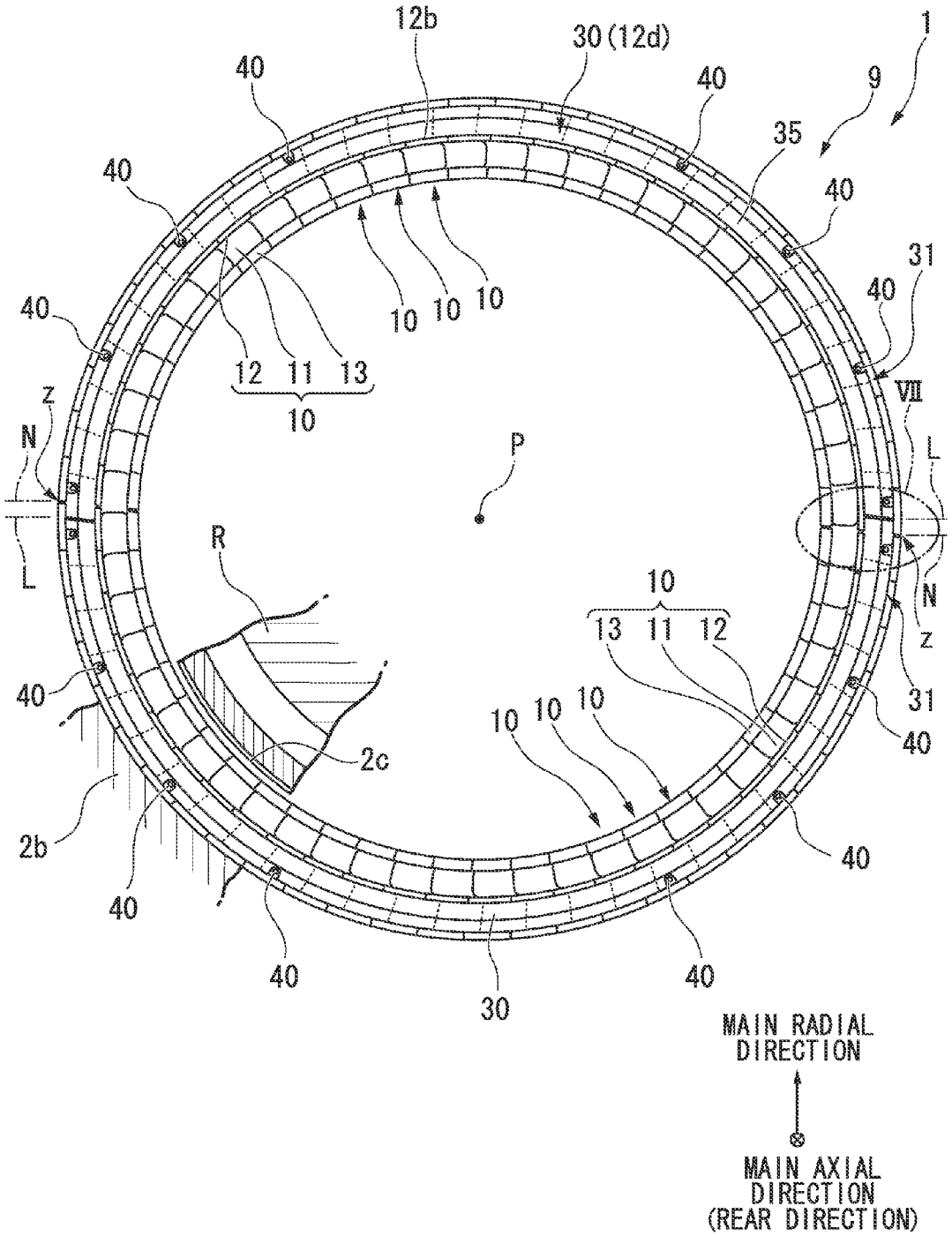
FIG. 4 is a cross-sectional view taken along the line III-III of FIG. 2 in the embodiment of the invention.

FIG. 4 is a cross-sectional view taken along the line III-III of FIG. 2.

Figure 5:
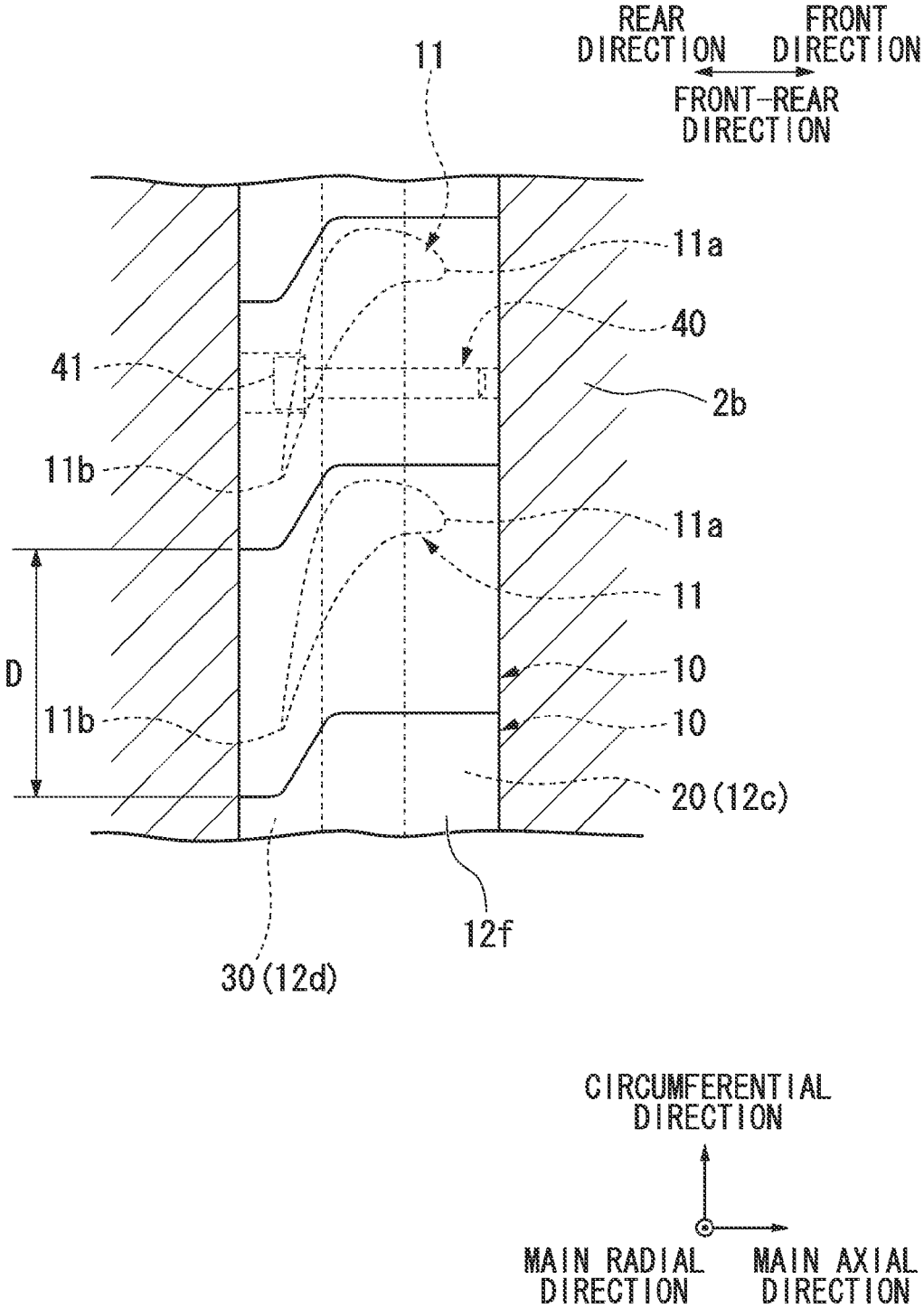
FIG. 5 is a cross-sectional view taken along the line IV-IV of FIG. 2 in the embodiment of the invention.

FIG. 5 is a cross-sectional view taken along the line IV-IV of FIG. 2.

Figure 6:
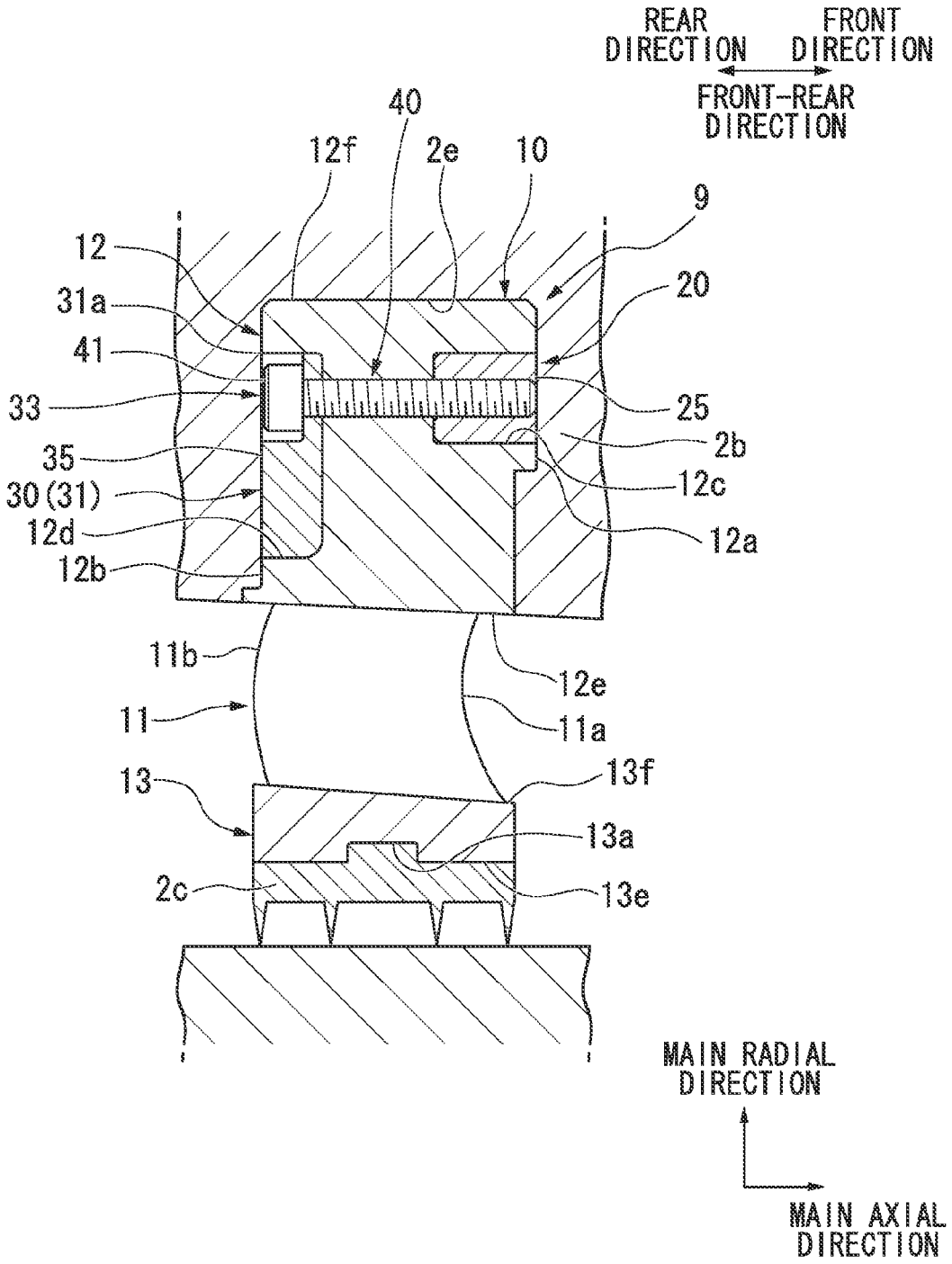
FIG. 6 is a cross-sectional view taken along the line V-V of FIG. 3 in the embodiment of the invention.

FIG. 6 is a cross-sectional view taken along the line V-V of FIG. 3.

Figure 7:
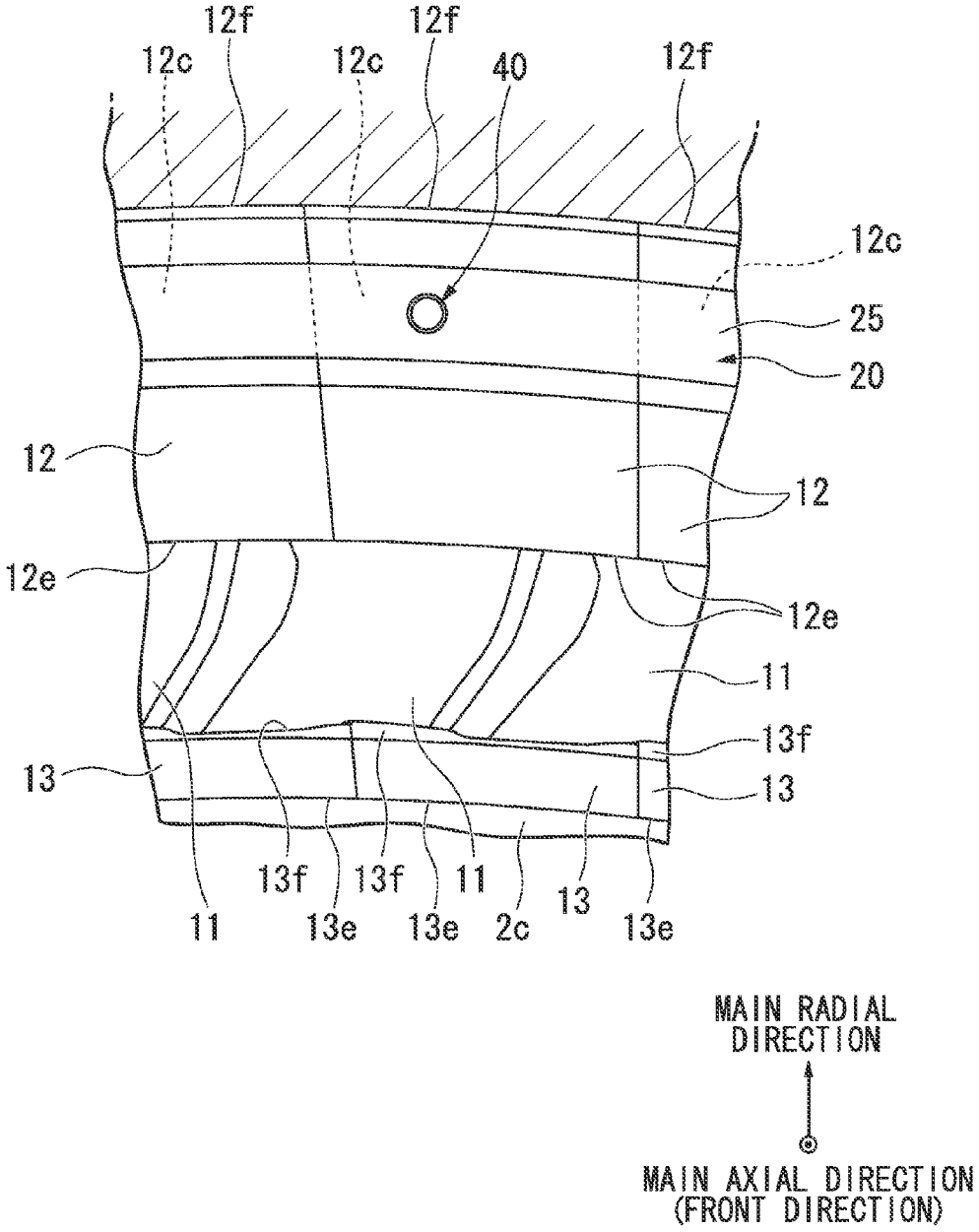
FIG. 7 is an enlarged view illustrating a main part VI of FIG. 3 in the embodiment of the invention.

FIG. 7 is an enlarged view illustrating a main part VI of FIG. 3.

Figure 8:
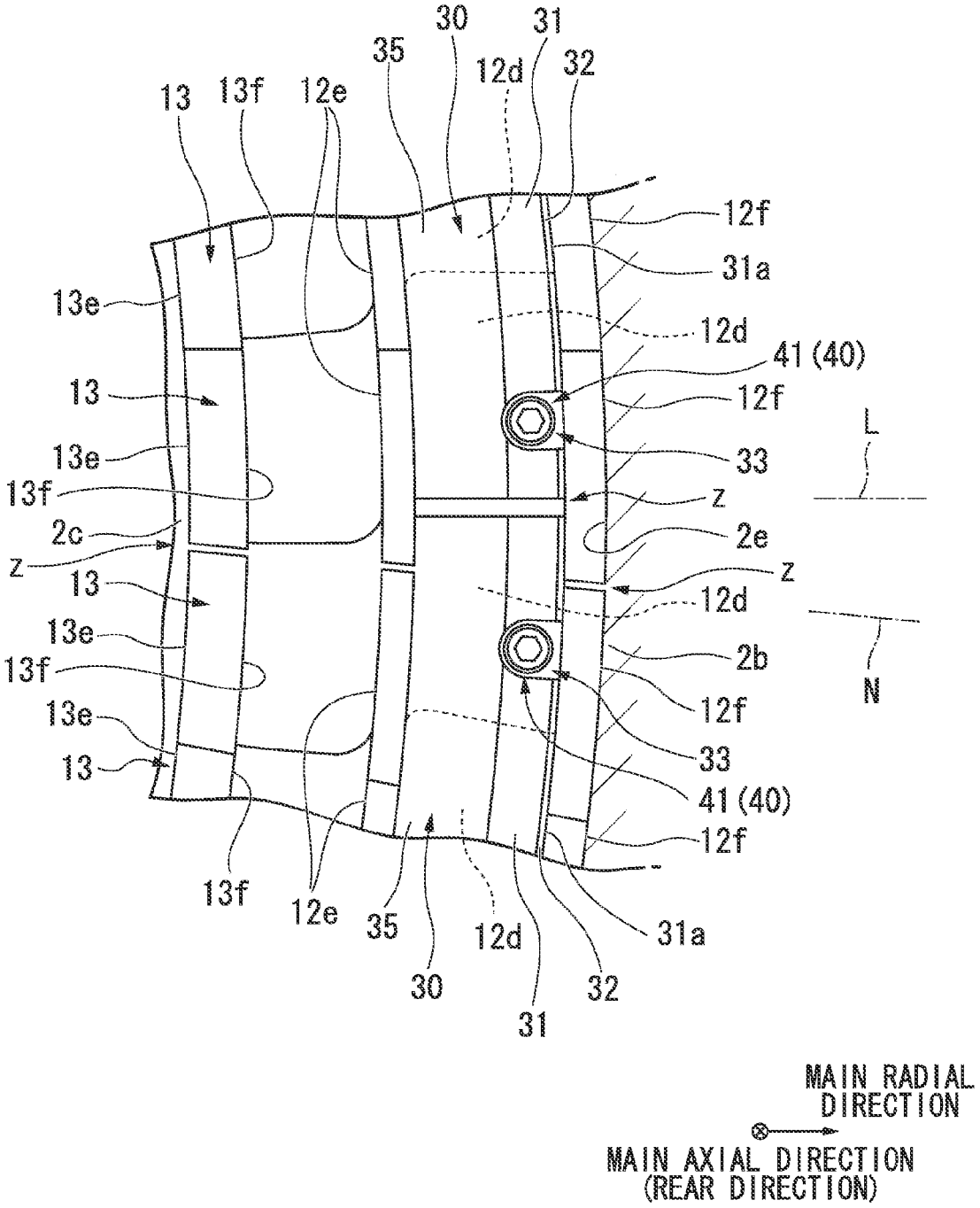
FIG. 8 is an enlarged view illustrating a main part VII of FIG. 4 in the embodiment of the invention.

FIG. 8 is an enlarged view illustrating a main part VII of FIG. 4.

As shown in FIGS. 2 and 3, the stationary vane unit 9 includes a plurality of stationary vane members 10, and a front band member (a first band member) 20. Then, as shown in FIGS. 4 and 6, the stationary vane unit includes a rear band member (a second band member) 30 and a plurality of fastening bolts (fastening members) 40, where the central axis P of the stationary vane unit overlaps the rotary shaft of the rotor R.

As shown in FIGS. 2 and 6, each of the plurality of stationary vane members 10 includes a stationary vane body 11, an outer shroud 12 which is connected to the base end of the stationary vane body 11, and an inner shroud 13 which is connected to the front end of the stationary vane body 11.

As shown in FIG. 5, in the cross-sectional shape of the vane of the stationary vane body 11, a thick front edge 11*a* is directed toward one direction, and a sharp rear edge 11*b* is directed toward intersected direction with the above-described one direction. Hereinafter, one direction to which the front edge 11*a* is directed is set as the "front direction", the opposite direction thereof is set as the "rear direction", and the front direction and the rear direction are both set as the "front-rear direction".

As shown in FIG. 5, the dimension D of the outer shroud 12 in the width direction perpendicular to the front-rear direction when the stationary vane member 10 is seen from one side of the longitudinal direction is set to be substantially uniform from the front portion (one end portion) 12*a* to the rear portion (the other end portion) 12*b*. Then, the outer shroud 12 extends in the front-rear direction from the front portion 12*a* toward the rear portion 12*b*, extends in the direction toward the rear edge 11*b* of the stationary vane body 11, and then extends in the front-rear direction. As shown in FIGS. 7 and 8, the outer shroud 12 is slightly curved so that the inner end surface 12*e* connected to the stationary vane body 11 is concave and the outer end surface 12*f* opposite to the inner end surface 12*e* is convex. Furthermore, the inner end surface 12*e* and the outer end surface 12*f* may be formed in a plane shape.

As shown in FIGS. 2 and 6, the outer shroud 12 includes a front fitting groove 12*c* which is provided in the front portion 12*a* in the front direction and a rear fitting groove 12*d* which is provided in the rear portion 12*b*.

As shown in FIGS. 2 and 6, the front fitting groove 12*c* is formed at the side of the outer end surface 12*f* in the front portion 12*a*, and the cross-section of the groove is formed in a square shape. As shown in FIG. 7, the front fitting groove 12*c* extends in a circular-arc-band shape when seen in the main axial direction so as to correspond to the curved shape of the outer shroud 12. As shown in FIGS. 2 and 6, the rear fitting groove 12*d* is formed from the outer end surface 12*f* to the inner end surface 12*e* in the rear portion 12*b*, and the cross-section of the groove is formed in a rectangular shape. As shown in FIG. 8, the rear fitting groove 12*d* extends in a circular-arc-band shape when seen in the main axial direction so as to correspond to the curved shape of the outer shroud 12.

The inner shroud 13 is formed in a shape substantially similar to the shape of the outer shroud 12. However, as shown in FIGS. 2 and 6, a circumferential groove 13*a* is formed in the inner end surface 13*e* opposite to the outer end surface 13*f* connected to the stationary vane body 11. Furthermore, the inner race 2*c* is fitted to the circumferential groove 13*a*.

As shown in FIGS. 3 and 4, the stationary vane members 10 with such a configuration are continuously arranged about the central axis P in a state where the longitudinal direction is directed toward the main radial direction and the front-rear direction is directed toward the main axial direction. The outer shrouds 12 of the stationary vane members 10 are continuous in the circumferential direction so as to have an annular band shape, and the inner shrouds 13 are also continuous in the circumferential direction so as to have an annular band shape. Further, in the plurality of outer shrouds 12 which is continuous in an annular band shape, the front fitting grooves 12*c* and the rear fitting grooves 12*d* are connected in the circumferential direction so as to communicate with each other in an annular band shape as a whole.

The plurality of stationary vane members 10 is connected to each other by being fastened to the front band member 20 and the rear band member 30.

The front band member 20 is formed of, for example, heat-resistant steel. The front band member extends in an annular band shape when seen in the thickness direction of the front band member 20 as shown in FIG. 3, and has a square cross-section which is perpendicular to the extension direction as shown in FIGS. 2 and 6. The front band member 20 is fitted to the front fitting groove 12*c* which communicates in an annular band shape while the thickness direction is directed toward the main axial direction (the front-rear direction). As shown in FIGS. 2 and 6, an exposure surface 25, which is exposed to the outside from the front fitting groove 12*c* and faces the outer race 2*b*, of the front band member 20 is flat so as to be flush with the surface of the front portion 12*a* of the outer shroud 12.

The rear band member 30 is formed of, for example, heat-resistant steel or the like. The rear band member extends in an annular band shape when seen from the thickness direction of the rear band member 30 as shown in FIG. 4, and has a rectangular cross-section which is perpendicular to the extension direction as shown in FIGS. 2 and 6. As shown in FIGS. 4 and 8, the rear band member 30 is separated as two separate band bodies (circular-arc-band-like bodies) 31, and the two separate bodies are fitted to the rear fitting groove 12*d* while both end portions thereof in the circumferential direction abut each other with the horizontal line L interposed therebetween. Then, the upper half of the plurality of stationary vane members 10 are fastened to each other by being interposed between the upper separate band body 31 and the front band member 20, and the lower half of the plurality of stationary vane members 10 are fastened to each other by being interposed between the lower separate band body 31 and the front band member 20.

In the upper half of the stationary vane members 10 and the lower half of the stationary vane members 10, the outer shrouds 12 and the inner shrouds 13 come into close contact with each other in the circumferential direction. On the other hand, as shown in FIG. 8, the stationary vane members 10 at both end portions of the upper half in the circumferential direction and the stationary vane members 10 at both end portions of the lower half in the circumferential direction are faced each other across a parting line N with interposing a gap therebetween. The parting line N is set to be slightly deviated to one side in the circumferential direction with respect to the horizontal line L.

As shown in FIGS. 2 and 6, an exposure surface 35, which is exposed to the outside from the rear fitting groove 12*d* and faces the outer race 2*b*, of each separate band body 31 is flat so as to be substantially flush with the surface of the rear portion 12*b* of each outer shroud 12. Further, as shown in FIG. 2, an outer peripheral edge 31*a* of the exposure surface 35 of each separate band body 31 is provided with a notched groove 32 having a sharp groove bottom. The outer peripheral-side wall portion 32*a* of the notched groove 32 comes into close contact with an inner peripheral wall surface 12*x* of the rear fitting groove 12*d* while being crushed toward the outer peripheral side.

As shown in FIG. 6, two separate band bodies 31 are fastened to the front band member 20 by a plurality of fastening bolts 40 which penetrates the outer shroud 12 in the front-rear direction.

As shown in FIG. 6, the fastening bolt 40 penetrates the outer shroud 12 from the separate band body 31 to the front band member 20. Further, as shown in FIG. 8, a bolt head 41 is received in a bolt receiving hole 33 which is notched inward in a semi-circular shape from the outer peripheral edge 31*a* of the separate band body 31. Further, as shown in FIG. 6, the bolt tip is exposed from the exposure surface 25 of the front band member 20.

As shown in FIGS. 3 and 4, in the embodiment, a plurality of fastening bolts 40 is disposed in each separate band body 31 with a gap therebetween in the circumferential direction. More specifically, in each of the upper half of the stationary vane members 10 and the lower half of the stationary vane members 10, a pair of fastening bolts 40 is disposed at the stationary vane member 10 disposed at both end portions in the circumferential direction. Further, three pairs of fastening bolts 40 are arranged every other two intervals in the circumferential direction from two stationary vane members 10 which are positioned at both end portions in the circumferential direction. Furthermore, eight stationary vane members 10 are positioned between the pair of fastening bolts 40 disposed at the inside of the circumferential direction when seen from the main axial direction. Furthermore, the number of the fastening bolts 40 or the number of the stationary vane members 10 to which the fastening bolt 40 is connected may be arbitrarily set.

In this way, when each separate band body 31 is fastened to the front band member 20 at four pairs of fastening bolts 40, the upper half of the plurality of stationary vane members 10 are connected to the lower half thereof. Further, the upper half of the plurality of stationary vane members 10 and the lower half thereof are integrally connected to each other through the front band member 20.

As described above, according to the embodiment, since the front band member 20 and the rear band member 30 are fastened to each other so that the outer shrouds 12 of the plurality of stationary vane members 10 are connected to each other, there is no need to perform welding for the connection of the stationary vane members 10. Accordingly, since the thermal deformation of the stationary vane member 10 may be prevented during the assembly process of the stationary vane member 10, the assembly precision may be improved. Thus, the stationary vane unit 9 with high precision with respect to the design value may be obtained.

Further, since the front band member 20 and the rear band member 30 are fitted to the outer shrouds 12 of the plurality of stationary vane members 10, a positional deviation between the front band member 20 and the rear band member 30 with respect to the outer shroud 12 may be suppressed, and the precision with respect to the design value may be further improved.

Further, since the fastening bolt 40 penetrates the outer shroud 12 in the main axial direction, the fastening bolt 40 is positioned inside the stationary vane unit 9. Accordingly, since the fastening bolt 40 does not protrude outward from the stationary vane unit 9, the configuration of the stationary vane unit 9 may be compact.

Further, since the plurality of stationary vane members 10 is positioned between two fastening bolts 40, the plurality of stationary vane members 10 may be fastened by the two fastening bolts 40. Accordingly, since the number of the fastening bolts 40 decreases compared to the number of the stationary vane members 10, the number of components may be reduced.

Further, since the front band member 20 is formed in an annular band shape, the structure is stable and the rigidity improves. Accordingly, since the deformation is suppressed, the precision with respect to the design value may be improved.

Further, since the rear band member 30 is separated as the separate band bodies 31, the manufacturing tolerance may be adjusted by adjusting the position of the separate band body 31.

Further, since the rear band member 30 includes the outer peripheral-side wall portion 32*a* which is crushed at the outer periphery, the outer peripheral-side wall portion 32*a* comes into close contact with the outer shroud when the rear band member 30 is relatively displaced toward the outer shroud 12. Accordingly, the rattling of the rear band member 30 and the outer shroud 12 may be suppressed.

[Method of Producing Stationary Vane Unit]

Subsequently, the method of producing the stationary vane unit 9 will be described. According to the stationary vane unit 9, the above-described stationary vane unit 9 may be easily and highly precisely assembled.

The stationary vane unit 9 according to the embodiment is produced by using a stationary vane member 60, a front band member (a first band member) 70, a rear band member 80 (a second band member, two separate band bodies (circular-arc-band-like bodies) 81), and the fastening bolt 40.

Figure 9:
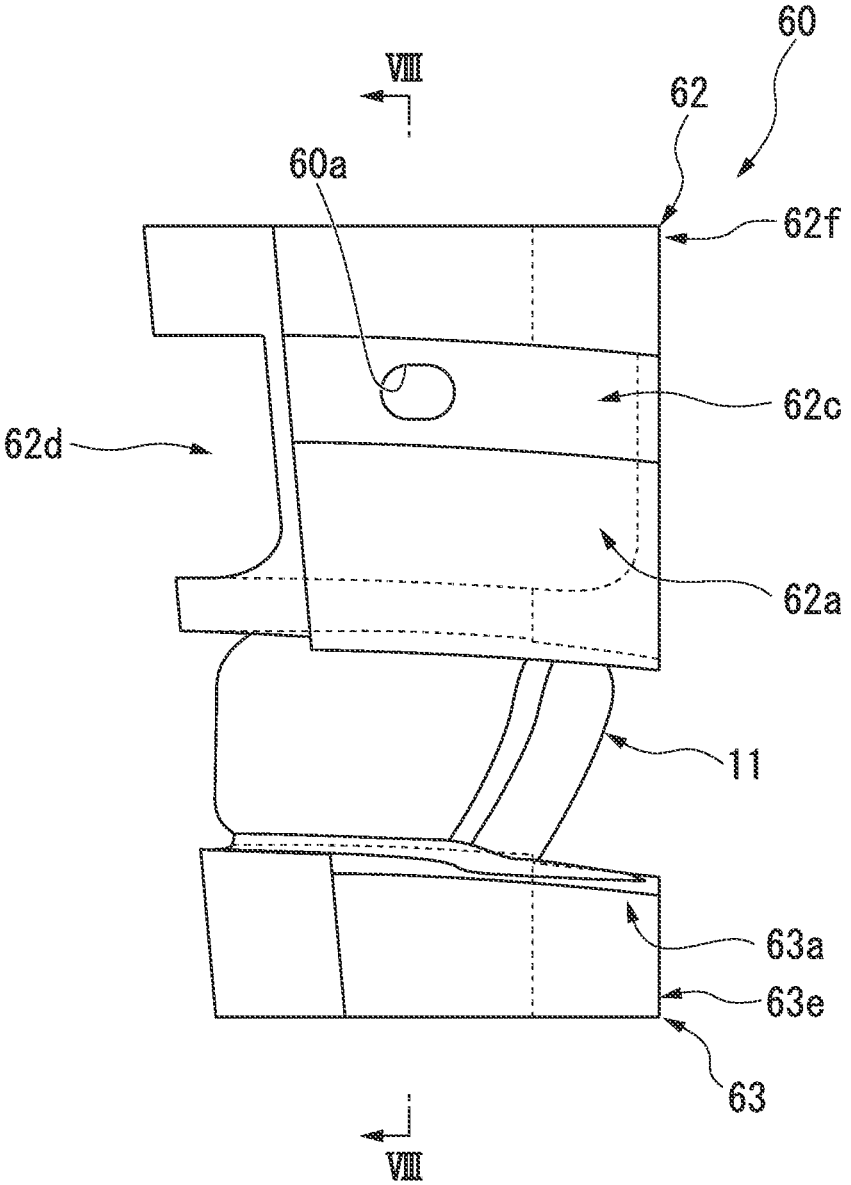
FIG. 9 is a front view illustrating a stationary vane member 60 according to the embodiment of the invention.

FIG. 9 is a front view illustrating the stationary vane member 60.

Figure 10:
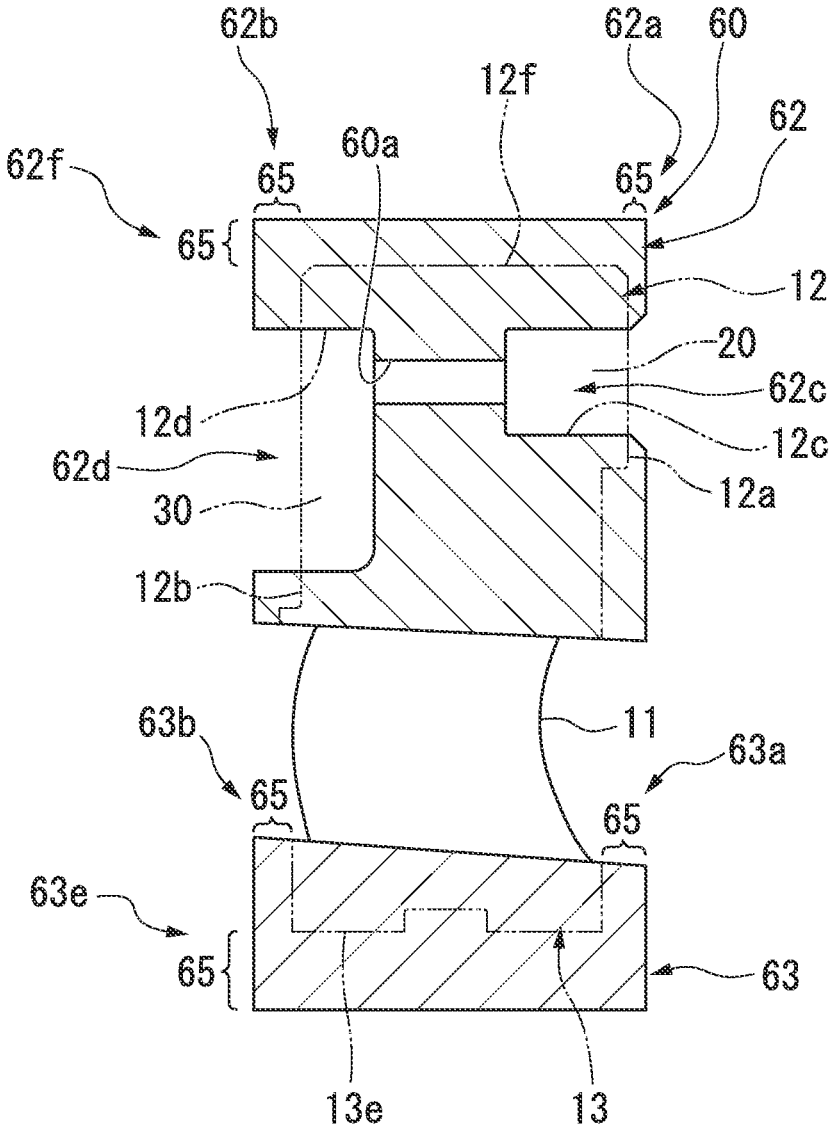
FIG. 10 is a cross-sectional view taken along the line VIII-VIII of FIG. 9 in the embodiment of the invention.

FIG. 10 is a cross-sectional view taken along the line VIII-VIII of FIG. 9.

As shown in FIG. 10, the stationary vane member 60 includes an outer shroud 62 and an inner shroud 63.

The outer shroud 62 is formed by providing a shroud cutting margin 65 in the outer shroud 12 of the stationary vane member 10.

The shroud cutting margin 65 is provided in an outer end portion 62*f* which corresponds to an outer end surface 12*f* of the outer shroud 12, a front portion (one end portion) 62*a* which corresponds to the front portion 12*a*, and a rear portion (the other end portion) 62*b* which corresponds to the rear portion 12*b* in the outer shroud 62.

The inner shroud 63 is formed by providing a shroud cutting margin 65 in the inner shroud 13 of the stationary vane member 10.

The shroud cutting margin 65 is provided in an inner end portion 63*e* which corresponds to the inner end surface 13*e* of the inner shroud 13, a front portion 63*a*, and a rear portion 63*b* in the inner shroud 63.

In the front portion 62*a* and the rear portion 62*b* of the outer shroud 62, a front fitting groove (a concave portion) 62*c* and a rear fitting groove 62*d* are respectively provided at positions corresponding to the front fitting groove 12*c* and the rear fitting groove 12*d* of the outer shroud 12. The front fitting groove 62*c* and the rear fitting groove 62*d* respectively have deep groove depths corresponding to the shroud cutting margin 65 compared to the front fitting groove 12*c* and the rear fitting groove 12*d*.

A through-hole (a penetration portion) 60*a* which penetrates the front fitting groove 12*c* and the rear fitting groove 12*d* is provided in the stationary vane member 60 corresponding to the penetration subject of the fastening bolt 40 in the plurality of stationary vane members 60. The through-hole 60*a* is formed as an elongated hole shape so that the size thereof in the width direction is larger than the size of the stationary vane member 60 in the longitudinal direction.

Figure 11:
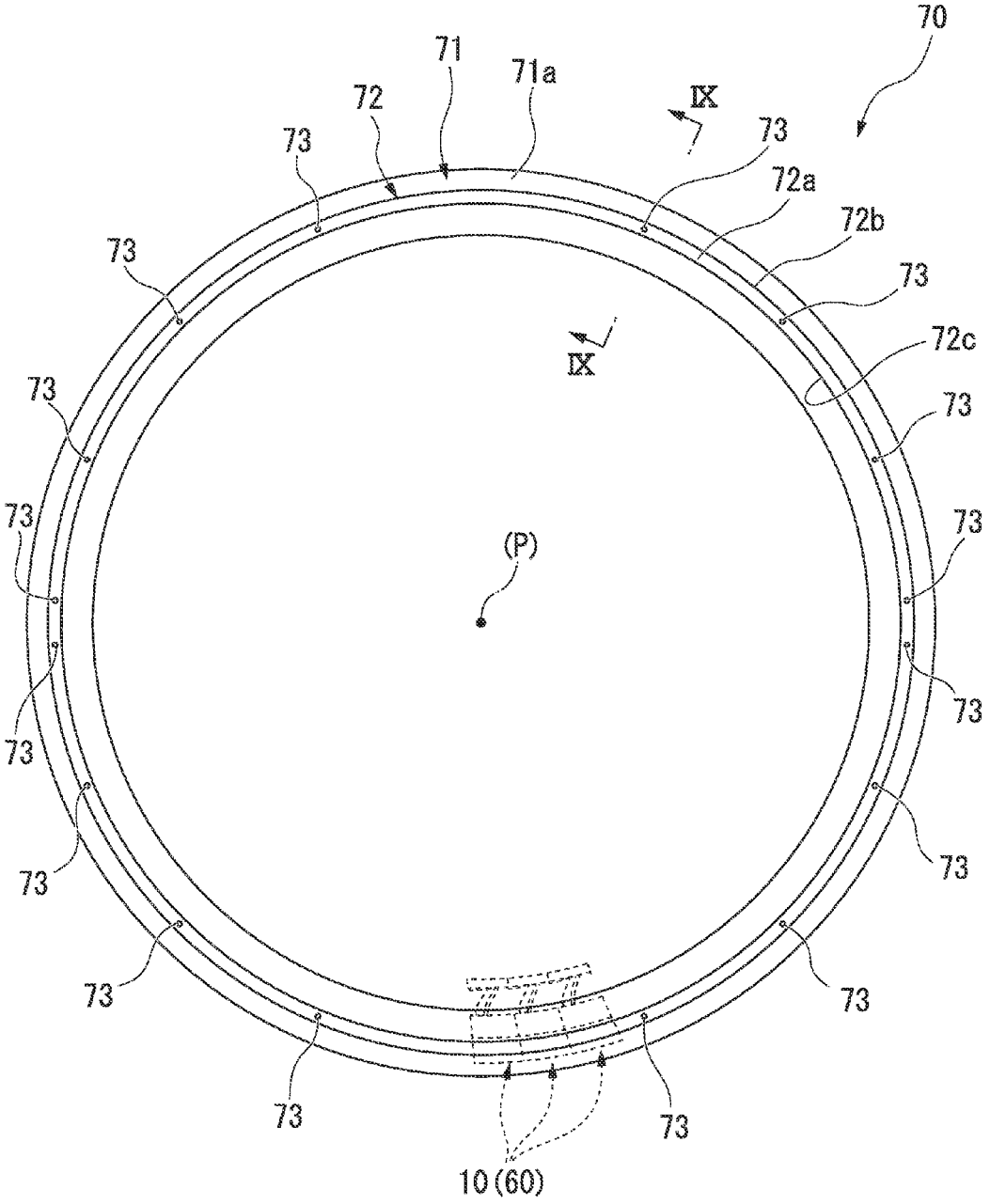
FIG. 11 is a plan view illustrating a front band member 70 according to the embodiment of the invention.

FIG. 11 is a plan view illustrating a front band member 70.

Figure 12:
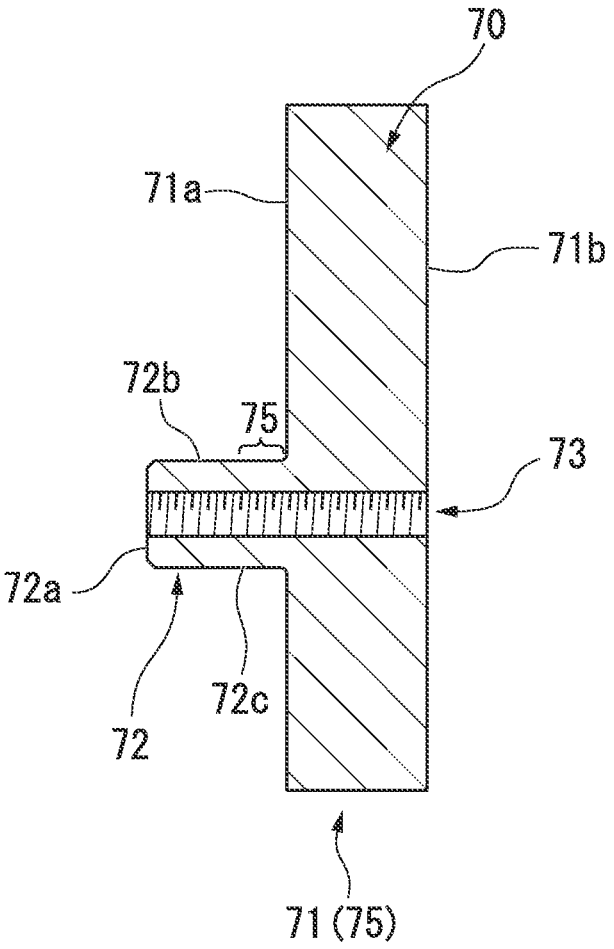
FIG. 12 is a cross-sectional view taken along the line IX-IX of FIG. 11 in the embodiment of the invention.

FIG. 12 is a cross-sectional view taken along the line IX-IX of FIG. 11.

The front band member 70 is formed by providing a band cutting margin 75 in the front band member 20, and extends in an annular band shape. The front band member 70 includes a base portion 71 which corresponds to the band cutting margin 75 and a protruding portion (a convex portion) 72 which protrudes from the base portion 71 and corresponds to the front band member 20.

As shown in FIG. 12, the width of the base portion 71 is larger than the dimension of the rear portion 62*b* of the outer shroud 62 in the longitudinal direction of the stationary vane member 60, and the thickness is larger than the length of the protruded part of the protruding portion 72. Accordingly, the torsional rigidity and the bending rigidity of the front band member 70 are improved.

As shown in FIG. 12, the base portion 71 includes a floor surface 71*b* which is formed to be flat and a floor surface 71*a* which is opposite to the floor surface 71*b* and is divided into two parts by the protruding portion 72. The floor surfaces 71*a* and 71*b* are respectively formed in an annular-band-like shape.

As shown in FIG. 11, the protruding portion 72 protrudes in the direction perpendicular to the floor surface 71*a*. The protruding portion 72 is formed in a substantially square shape in the cross-sectional view and is connected with the front fitting groove 62*c*. A front end surface (the reference surface) 72*a*, an outer peripheral surface 72*b*, and an inner peripheral surface 72*c* of the protruding portion 72 may come into contact with the groove inner wall surface of the front fitting groove 62*c*. The base end side of the protruding portion 72 in the protruding direction is formed as the band cutting margin 75.

In the front band member 70, a plurality of female screws 73 is formed at positions corresponding to the arrangement positions of the fastening bolts 40 so as to penetrate the base portion 71 and the protruding portion 72 in the thickness direction and allow the fastening bolt 40 to be threaded thereinto.

Figure 13:
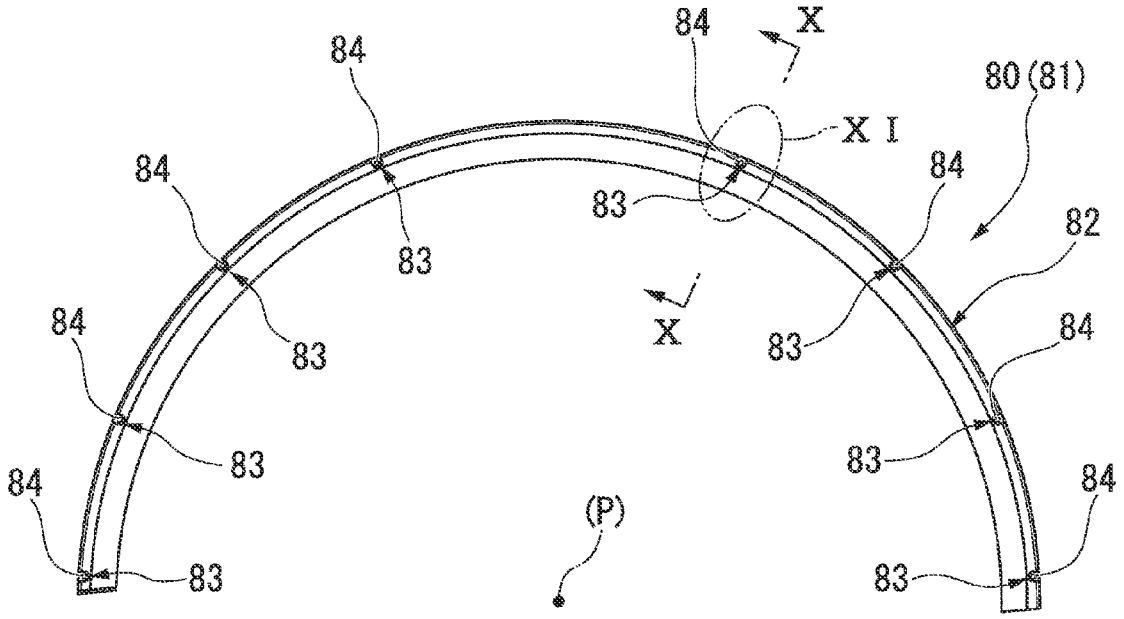
FIG. 13 is a plan view illustrating a rear band member 80 according to the embodiment of the invention.

FIG. 13 is a plan view illustrating a separate band body 81 of a rear band member 80.

Figure 14:
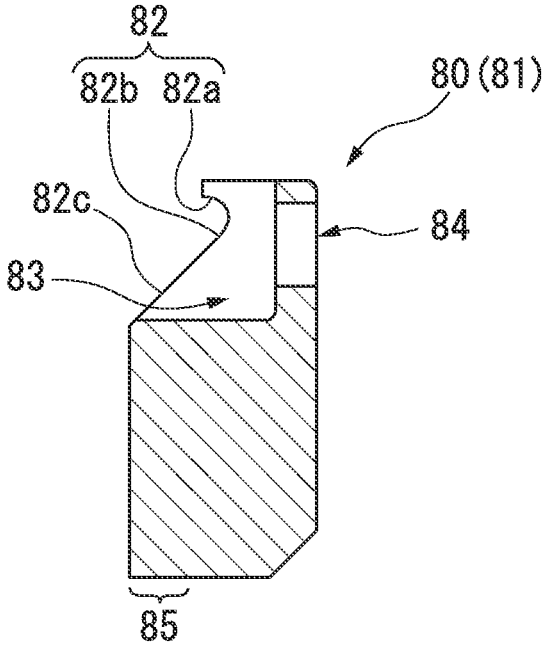
FIG. 14 is a cross-sectional view taken along the line X-X of FIG. 13 in the embodiment of the invention.

FIG. 14 is a cross-sectional view taken along the line X-X of FIG. 13.

Figure 15:
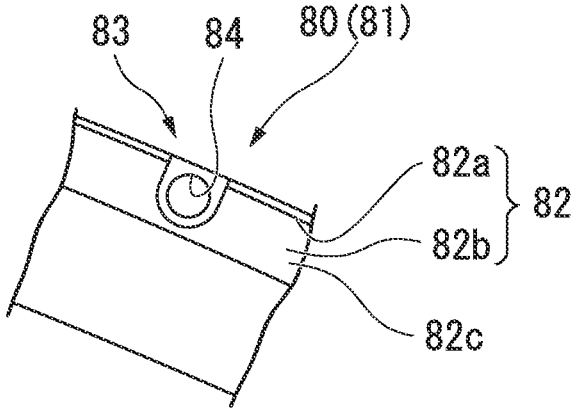
FIG. 15 is an enlarged view illustrating a main part XI of FIG. 13 in the embodiment of the invention.

FIG. 15 is an enlarged view illustrating a main part XI of FIG. 13.

The separate band body 81 is formed by providing a band cutting margin 85 in the separate band body 31, and is formed so as to be thicker than the rear band member 30. The separate band body 81 extends in a semi-annular band shape, and a notched groove 82 is formed at a position corresponding to the notched groove 32 of the rear band member 30. As shown in FIG. 14, the notched groove 82 is formed in a quarter-circular-arc shape in the cross-sectional view taken along the thickness direction. The notched groove 82 includes a curved surface 82*a* of which the rate of an increase in groove depth gradually decreases from the outer peripheral side of the rear band member 80 toward the inner peripheral side thereof and a slope 82*b* which is connected to the curved surface 82*a* and of which the groove depth gradually decreases from the curved surface 82*a* toward the inner peripheral side of the rear band member 80. Then, an extension slope 82*c* extends in the band cutting margin 85 from the slope 82*b* toward the inner periphery of the rear band member 80. The rear band member 80 is provided with a bolt receiving hole 83 (a bolt receiving hole 33) which is formed in the outer peripheral edge of the rear band member 80 so as to correspond to the fastening position of the fastening bolt 40 and a through-hole 84 which penetrates the bolt receiving hole 83 in the thickness direction of the rear band member 80.

Figure 16:
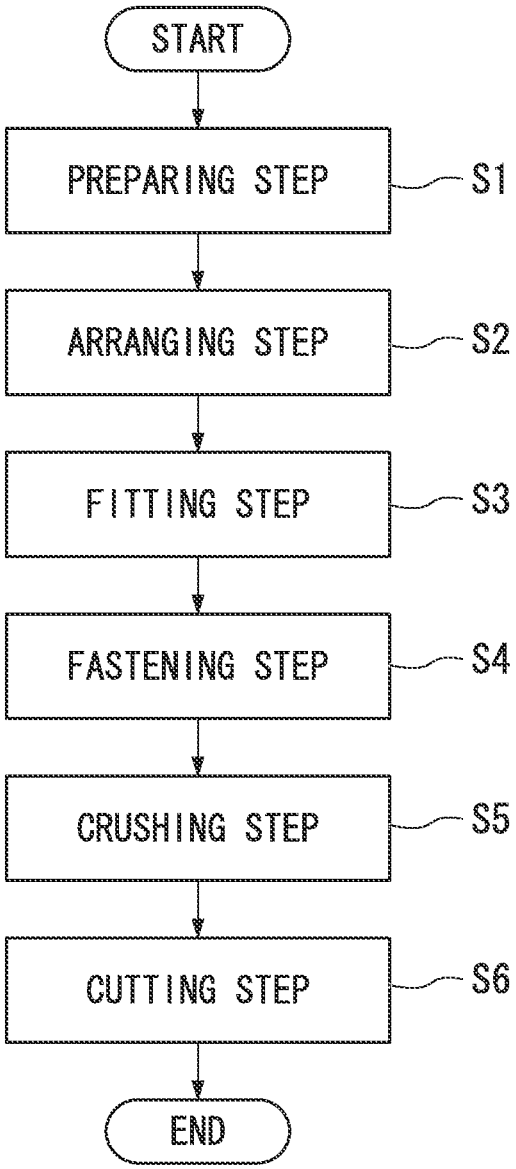
FIG. 16 is a flowchart illustrating a process of producing a stationary vane unit 9 according to the embodiment of the invention.
Figure 18:
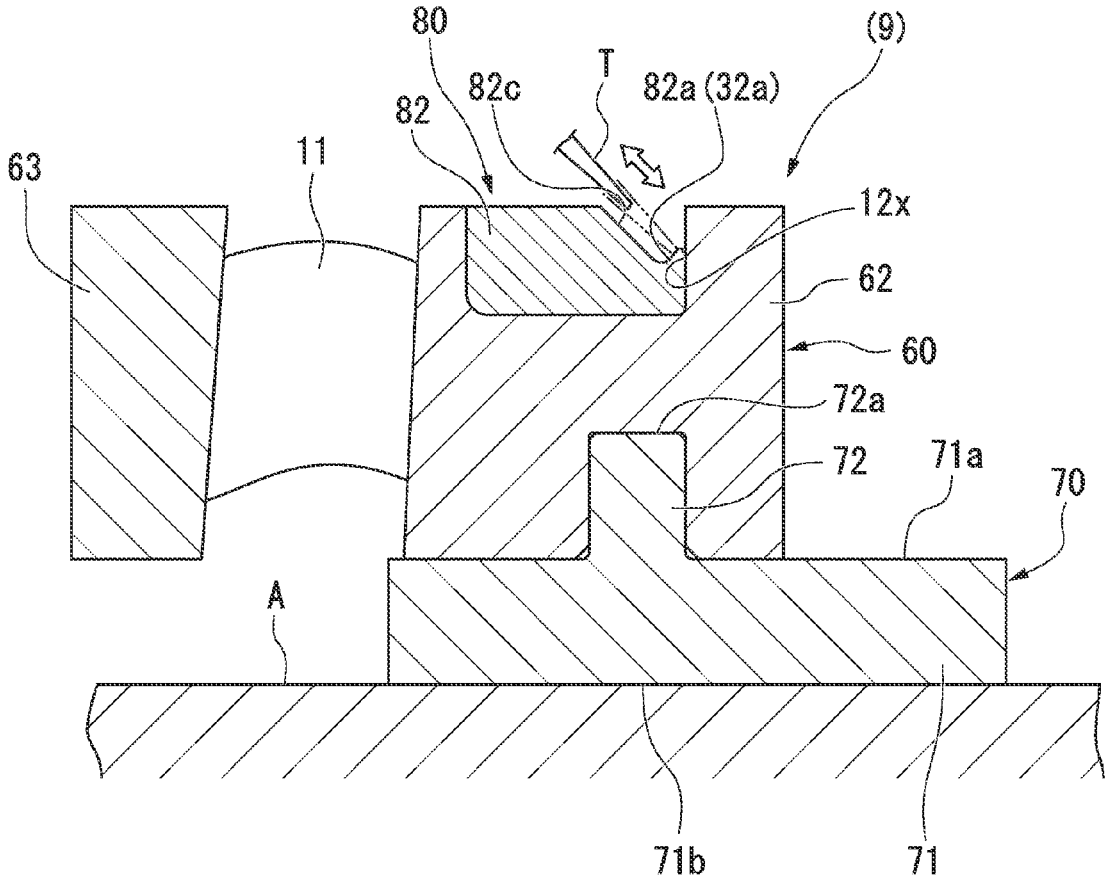
FIG. 18 is a schematic diagram illustrating a crushing step in the process of producing the stationary vane unit 9 according to the embodiment of the invention.
Figure 19:
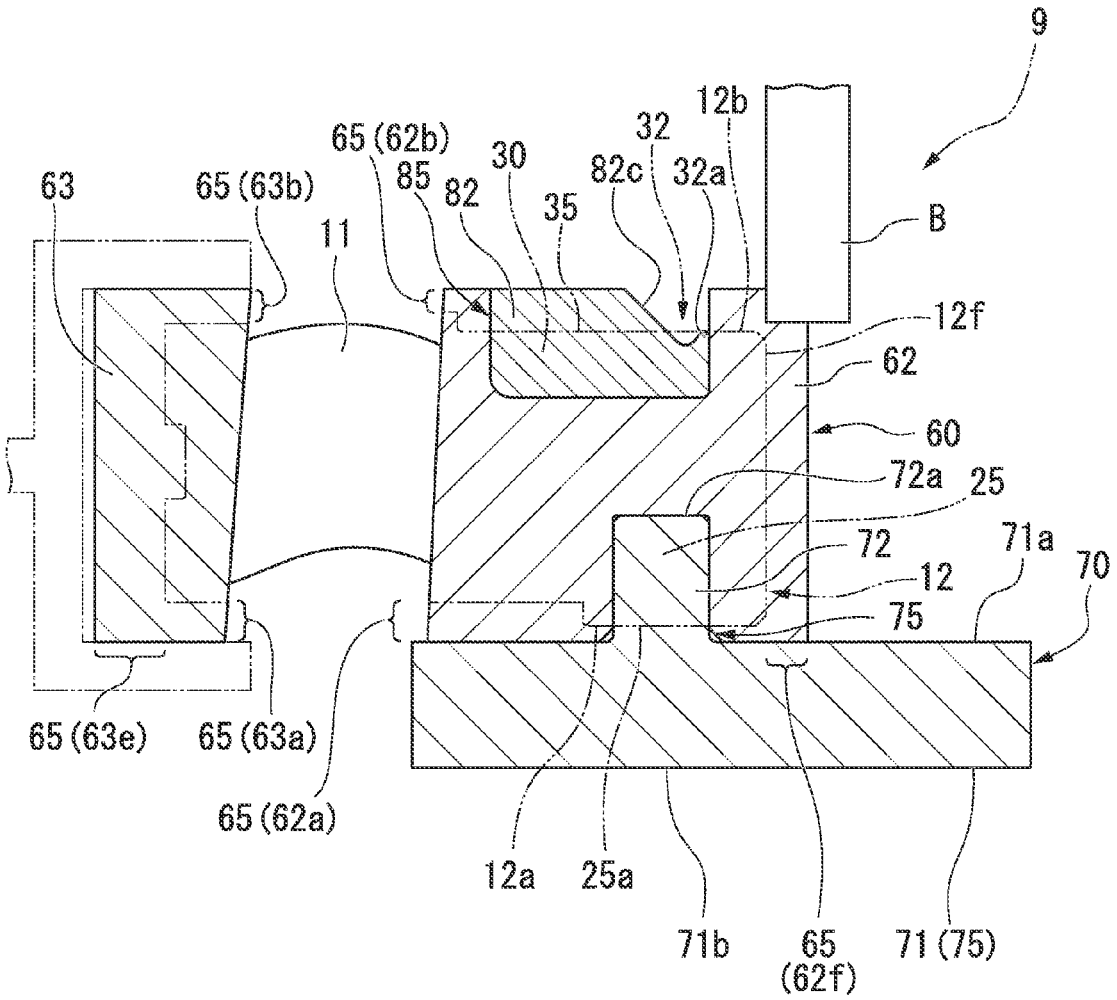
FIG. 19 is a schematic diagram illustrating a cutting step in the process of producing the stationary vane unit 9 according to the embodiment of the invention.

Subsequently, the detailed assembly method of the stationary vane unit 9 will be described. FIG. 16 is a flowchart illustrating a process of producing the stationary vane unit 9, and FIGS. 17 to 19 are schematic diagrams illustrating each step of the process of producing the stationary vane unit 9.

As shown in FIG. 16, first, the stationary vane member 60, the front band member 70, two rear band members 80, and the plurality of fastening bolts 40 described above are prepared (a preparing step S1).

Figure 17:
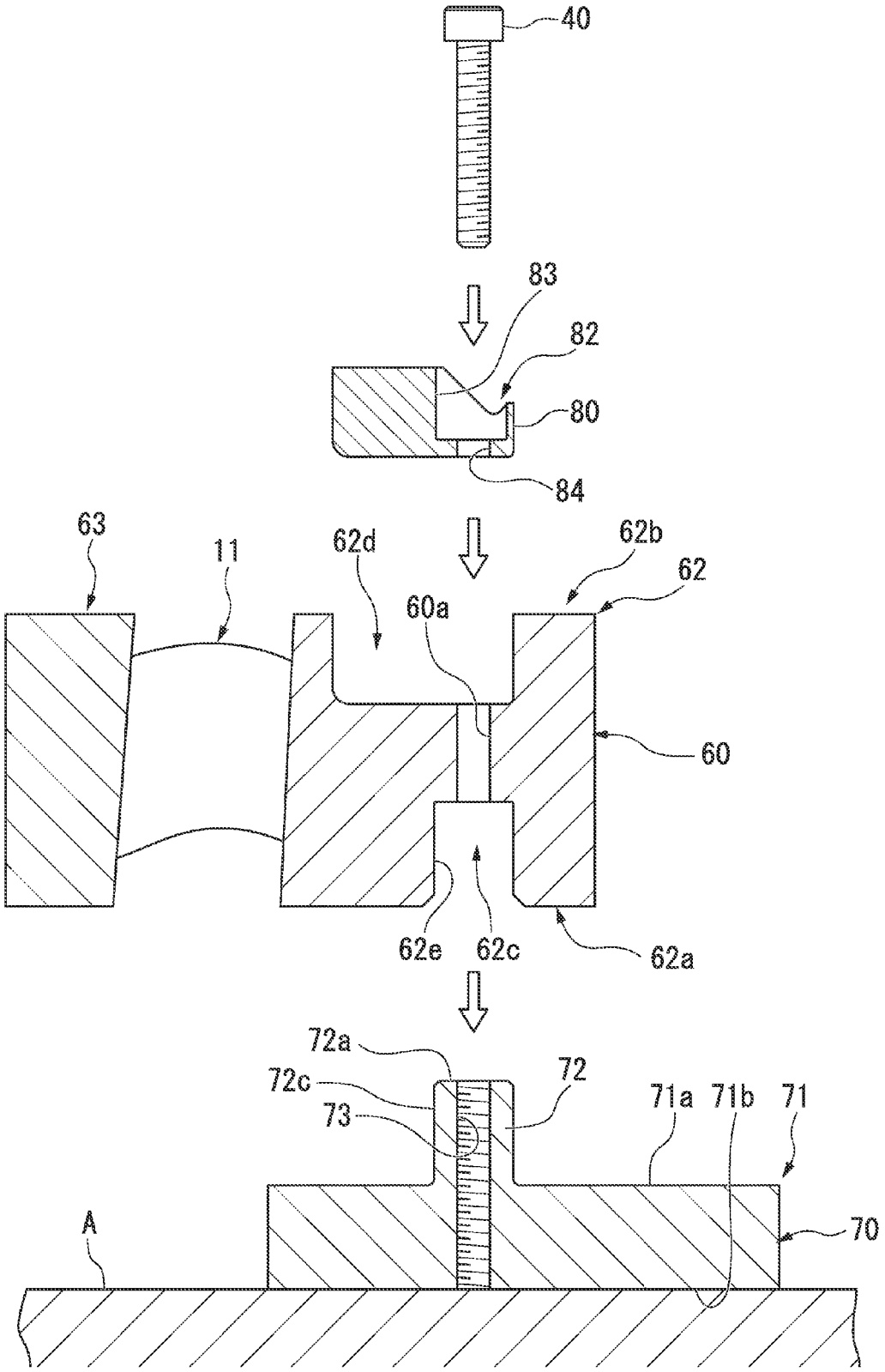
FIG. 17 is a schematic diagram illustrating an arranging step, a fitting step, and a fastening step in the process of producing the stationary vane unit 9 according to the embodiment of the invention.

Next, as shown in FIGS. 16 and 17, the front band member 70 is placed on the work support surface A, and the plurality of stationary vane members 60 is arranged in a circumferential shape while the front portions 62*a* of the stationary vane members 60 are fitted to the front band member 70 (an arranging step S2, see FIG. 11). More specifically, the front band member 70 is placed on the work support surface A so that the floor surface 71*a* and the protruding portion 72 of the front band member 70 face the upside and the floor surface 71*b* faces the downside. The stationary vane members 60 are arranged in an annular band shape while the front fitting grooves 62*c* of the stationary vane members 60 are fitted to the protruding portion 72 of the front band member 70.

At this time, the stationary vane member 60 having the through-hole 60*a* is disposed on the female screw 73 formed in the front band member 70, and the female screw 73 of the front band member 70 overlaps the through-hole 60*a* of the stationary vane member 60. At this time, the stationary vane members 60 having the through-holes 60*a* are disposed so as to match the positions of the female screws 73, and the stationary vane member 60 disposed therebetween, so that the stationary vane members 60 may be easily arranged in the circumferential direction. More specifically, the upper half of the stationary vane members 60 and the lower half of the stationary vane members 60, the outer shrouds 62 and the inner shrouds 63 are brought into contact with each other in the circumferential direction. Further, the stationary vane members are arranged so that a gap Z is formed between each of the stationary vane members 60 at both end portions of the upper half of the stationary vane members 60 in the circumferential direction and each of the stationary vane members 60 at both end portions of the lower half stationary vane member 60 in the circumferential direction. At this time, since the through-hole 60*a* of the stationary vane member 60 is formed in an elongated hole shape, the relative position of the stationary vane member 60 with respect to the front band member 70 may be adjusted within the range where the through-hole 60*a* and the female screw 73 overlap each other.

In this way, the plurality of stationary vane members 60 is arranged in a semi-annular band shape which halves them, so that they are arranged in an annular band shape as a whole. At this time, in the respective outer shrouds 62 of the plurality of stationary vane members 60 arranged in an annular band shape, the rear fitting grooves 62*d* communicate with each other in an annular band shape.

Next, as shown in FIGS. 16 and 17, the rear band member 80 is fitted to the rear portions 62*b* of the respective outer shrouds 62 of the plurality of stationary vane members 60 arranged in a circumferential shape on the front band member 70 (a fitting step S3).

Specifically, the rear band members 80 are fitted to the rear fitting grooves 62*d* communicating with each other in an annular band shape in a state where the respective notched grooves 82 of the two semi-circular-arc-band-like rear band members 80 face the upside. At this time, the plurality of through-holes 84 of the rear band members 80 is made to overlap the female screws 73 of the front band member 70 and the through-holes 60*a* of the stationary vane members 60.

Next, as shown in FIGS. 16 and FIG. 17, the front band member 70 and the rear band members 80 are fastened to each other so that the outer shrouds 62 of the plurality of stationary vane members 60 are fastened to each other by the front band member 70 and the rear band members 80 (a fastening step S4).

Specifically, the fastening bolt 40 is inserted through the bolt receiving hole 83, the female screw 73, and the through-hole 60*a* which communicate with each other, and the fastening bolt 40 is threaded into the female screw 73. At this time, it is desirable to fasten the fastening bolt 40 in a state where the inner peripheral surface 62*e* of the front fitting groove 62*c* of the outer shroud 62 of the stationary vane member 60 is pressed against the inner peripheral surface 72*c* of the front band member 70 and the rear band member 80 is pressed against the rear fitting groove 62*d*.

Next, as shown in FIGS. 16 and 18, the rear band member 80 is plastically deformed in the radial direction of the rear band member 80 by applying an external force to the rear band member 80, so that the gap between the rear band member 80 and each stationary vane member 60 is filled (a crushing step S5).

Specifically, the curved surface 82*a* is pressed in the inclined direction and the curved surface 82*a* of the rear band member 80 is crushed toward the inner peripheral wall surface 12*x* in a state where a chisel portion T (or a hammer portion of an air hammer) of a jet chisel (name of commodity; Nitto Kohki Co., Ltd.) which can be driven by high-pressure air is made to follow the extension slope 82*c*. At this time, since the chisel portion T is made to follow the extension slope 82*c*, the chisel portion T may be stably supported, and the outer peripheral-side wall portion 32*a* may be obtained by crushing the curved surface 82*a* of the rear band member 80.

In this way, the radial gap between the rear band member 80 and the outer shroud 62 is filled.

Next, as shown in FIGS. 16 and 19, the band cutting margin 75 of the front band member 70, the band cutting margin 85 of the rear band member 80, and the shroud cutting margin 65 of the stationary vane member 60 are removed by cutting, where the band members are used to fasten the outer shrouds 62 of the stationary vane members 60 to each other (a removing step S6).

Specifically, the outer shroud 62 is first cut while the inner shroud 63 is gripped by a vertical turning machine (a tool bit B).

More specifically, the band cutting margin 75 at the base end side of the protruding portion 72 and the entire portion of the base portion 71 of the front band member 70 and the shroud cutting margin 65 of the front portion 62*a* in the outer shroud 62 are removed. Accordingly, the exposure surface 25 of the front band member 20 and the surface of the front portion 12*a* flush with the exposure surface 25 are formed. On the other hand, the band cutting margin 85 including the extension slope 82*c* of the rear band member 80 and the shroud cutting margin 65 of the rear portion 62*b* of the outer shroud 62 are removed. Accordingly, the exposure surface 35 of the rear band member 30 and the surface of the rear portion 12*b* flush with the exposure surface 35 are formed. In the same manner, the shroud cutting margin 65 of the outer end portion 62*f* of the outer shroud 62 is cut, so that the outer end surface 12*f* is formed.

Next, the outer shroud 12 subjected to cutting at the side of the outer shroud 62 is gripped, and the shroud cutting margin 65 of the inner shroud 63 is cut, so that the inner shroud 13 is formed.

In this way, the production of the stationary vane unit 9 is completed.

As described above, according to the method of producing the stationary vane unit 9 of the embodiment, the plurality of stationary vane members 60 is arranged in the circumferential direction while the front portion 62*a* of the outer shroud 62 of the stationary vane member 60 is fitted to the front band member 70 disposed on the work support surface A. Then, the rear band members 80 are fitted to the rear portions 62*b* of the plurality of outer shrouds 62 continuous in the circumferential direction. For this reason, the front band member 70 and the rear band member 80 may be easily positioned with respect to the outer shroud 62 by the fitting between the front portion 62*a* and the front band member 70 and the fitting between the rear portion 62*b* and the rear band member 80. In other words, the front band member 70 and the rear band member 80 serve as not only a band, but also an assembly fixture. Accordingly, since the workability improves, the stationary vane unit 9 may be easily and highly precisely assembled.

Further, no heat inputs to the stationary vane member 60 due to the connection of the stationary vane members 60. Accordingly, since the stationary vane members 60 may be prevented from being thermally deformed during the assembly process of the stationary vane member 60, the assembly precision may be improved.

Thus, the stationary vane unit 9 with high precision with respect to the design value may be obtained.

Further, since the front band member 70 and the rear band member 80 are fastened to each other while the front portion 62*a* of the outer shroud 62 of the stationary vane member 60 is pressed against the floor surface 71*a* of the base portion 71 of the front band member 70, the front band member 70 may be prevented from being distorted or bent. Accordingly, since a gap may be suppressed from being formed between the front band member 70 and the plurality of stationary vane members 60, the stationary vane unit 9 may be assembled with high precision.

Further, the band cutting margins 75 and 85 provided in the front band member 70 and the rear band member 80 are removed by cutting. For this reason, even when the front band member 70 and the rear band member 80 increase in size so that the torsional rigidity or the bending rigidity improves and hence the assembly precision improves, the stationary vane unit 9 may be suppressed to a predetermined size.

Especially, in the embodiment, the front band member 70 is provided with the base portion 71 so as to improve the torsional rigidity or the bending rigidity of the protruding portion 72, so that the function as the fixture improves. However, since the shroud cutting margin 65 is removed at the assembly completion time when the function as the fixture is not needed, the outer shroud 12 may be easily decreased in size.

Further, since the shroud cutting margin 65 of the stationary vane member 60 is removed together with the band cutting margins 75 and 85, the removing work may be easily performed.

Further, since the circumferential gap between the rear band member 80 and the outer shroud 62 is filled, the rattling occurring between the rear band member 80 and the outer shroud 62 may be suppressed.

Especially, in the embodiment, the rear band member 80 is formed so as to be smaller than the front band member 70 in which the base portion 71 is provided so as to improve the torsional rigidity or the bending rigidity. For this reason, the rear band member 80 may be twisted or bent so that a circumferential gap is formed between the outer shrouds 62. According to the embodiment, since such a circumferential gap may be filled, the rattling may be effectively suppressed.

Further, according to the method of connecting the stationary vane unit 9 of the rotary machine, since the front band member 70 and the rear band member 80 are fastened to each other so that the outer shrouds 62 of the plurality of stationary vane members 60 are connected to each other, there is no need to perform welding for the connection of the stationary vane members 60. Accordingly, since the stationary vane members 60 may be prevented from being thermally deformed during the assembly process of the stationary vane member 60, the assembly precision may be improved. Thus, the stationary vane unit 9 with high precision with respect to the design value may be obtained.

Further, in a case where the outer shrouds 12 (62) are connected to each other by welding, an annealing process needs to be performed, and the precision with respect to the design value is not easily satisfied due to thermal strain or degradation in surface roughness of the stationary vane body 11. However, according to the embodiment, the stationary vane unit 9 may be obtained in which the stationary vane body 11 has satisfactory surface roughness, but does not have thermal strain.

Further, in a case where the outer shrouds 12 (62) are connected to each other by welding, when the stationary vane member 10 (60) is locally damaged, it is difficult to replace the stationary vane member since the outer shrouds 12 (62) are melted to be integrated with each other. However, according to the embodiment, since the stationary vane member 10 (60) may be locally replaced by loosening the fastening bolt 40, the maintenance workability may be improved.

Further, in a case where welding is used for the connection of the outer shroud 12, the processing after the welding connection is difficult since the machining reference of the main axial direction is not provided. However, according to the embodiment, since the front end surface 72*a* is used as the machining reference of the main axial direction, the processing after the connection may be easily performed.

Furthermore, the operation sequence or all shapes or combinations of the respective components shown in the above-described embodiment is an example, and may be modified variously based on the requirement of the design or the like without departing from the spirit of the invention.

For example, according to the above-described embodiment, the fastening bolt 40 penetrates a part of the plurality of stationary vane members 10 (60), but the fastening bolt 40 may penetrate the entire portion of the stationary vane member 10 (60).

Further, in the above-described embodiment, the front band member 20 (70) is formed in an annular band shape, but the plurality of separate band bodies may be formed in an annular band shape.

Further, in the above-described embodiment, the rear band member 30 is separated into two separate band bodies 31, but may be separated into three or more bodies or may be connected to each other as one body without separation.

Further, in the above-described embodiment, only the outer peripheral-side wall portion 32*a* of the rear band member 30 (80) is crushed, but the front band member 20 (70) may be crushed.

Further, in the above-described embodiment, the front end surface 72*a* is formed in the protruding portion 72 which protrudes from the base portion 71 of the front band member 70. However, the base portion and the protruding portion may be formed in the rear band member 80 so that the front end surface of the protruding portion is used as the reference surface. Further, the shroud cutting margin 65 and the band cutting margins 75 and 85 may not be necessarily provided.

Further, in the above-described embodiment, the stationary vane unit 9 of the invention is applied to the steam turbine 1, but the stationary vane unit 9 of the invention may be applied to a compressor of a gas turbine or a turbine.

BRIEF DESCRIPTION OF THE REFERENCE SYMBOLS

1 steam turbine
2 casing
9 stationary vane unit
10 stationary vane member
11 stationary vane body
12 outer shroud
12*a* front portion
12*b* rear portion
20 front band member
30 rear band member
31 separate band body (circular-arc-band-like bodies)
40 fastening bolt
60 stationary vane member
60*a* through-hole (penetration portion)
62 outer shroud
62*a* front portion
62*b* rear portion
62*c* front fitting groove (concave portion)
65 shroud cutting margin
70 front band member

71 base portion
72 protruding portion (convex portion)
72*a* front end surface (reference surface)
75 band cutting margin
80 rear band member
81 separate band body
85 band cutting margin
S1 preparing step
S2 arranging step
S3 fitting step
S4 fastening step
A work support surface
P central axis
R rotor

What is claimed is:

1. A stationary vane unit of a rotary machine in which a plurality of stationary vane members is arranged around a central axis and outer shrouds formed in outer peripheries of the stationary vane members are continuous in a circumferential direction so as to be connected to each other, the stationary vane unit comprising:

a first band member that extends in the circumferential direction and is accommodated in a first groove formed in the outer shrouds of the plurality of stationary vane members on a first side of the outer shrouds in a main axial direction in which the central axis extends;

a second band member that extends in the circumferential direction and is accommodated in a second groove formed in the outer shrouds of the plurality of stationary vane members on a second side of the outer shrouds in the main axial direction; and a fastening member that fastens the first band member and the second band member to each other so that the outer shrouds of the plurality of stationary vane members are connected to each other and the fastening member penetrates through the first band member, one of the outer shrouds, and the second band member in the main axial direction.

2. The stationary vane unit of the rotary machine according to claim 1, wherein at least one of the first band member and the second band member is fitted to the outer shrouds of the plurality of stationary vane members.

3. The stationary vane unit of the rotary machine according to claim 1, wherein the fastening member is one of a plurality of fastening members provided in the circumferential direction at intervals, and at least one stationary vane member is positioned between two fastening members which make a pair and are adjacent to each other in the circumferential direction.

4. The stationary vane unit of the rotary machine according to claim 1, wherein at least one of the first band member and the second band member is formed in an annular shape.

5. The stationary vane unit of the rotary machine according to claim 1, wherein at least one of the first band member and the second band member is formed in an annular shape and is divided into multiple circular arc band bodies.

6. The stationary vane unit of the rotary machine according to claim 1, wherein at least one of the first band member and the second band member is buried in one of the outer shrouds of the stationary vane members, and includes a crushed portion which is plastically deformed toward the one of the outer shrouds.

7. The stationary vane unit of the rotary machine according to claim 1, wherein the one of the outer shrouds includes a penetration portion through which the fastening member passes and which extends from a first side of the one of the outer shrouds toward a second side of the one of the outer shrouds in the main axial direction.

8. The stationary vane unit of the rotary machine according to claim 1, wherein the fastening member is a fastening bolt.

9. The stationary vane unit of the rotary machine according to claim 8, wherein an axial length of the fastening bolt is less than or equal to an axial thickness of the one of the outer shrouds.

10. The stationary vane unit of the rotary machine according to claim 1, wherein the fastening member has a head at a terminal end of the fastening member, the head being exposed outside one of the first band member and the second band member.

11. A method of producing a stationary vane unit of a rotary machine in which a plurality of stationary vane members is arranged around a central axis and outer shrouds formed in outer peripheries of the stationary vane members are continuous in a circumferential direction so as to be connected to each other, the method comprising:

preparing the plurality of stationary vane members, a first band member which extends in the circumferential direction and is connected with a first end portion of each of the outer shrouds from a first side of the outer shrouds in a main axial direction in which the central axis extends, and a second band member which extends in the circumferential direction around the central axis and is connected with a second end portion of each of the outer shrouds from a second side of the outer shrouds in the main axial direction;

arranging the plurality of stationary vane members in the circumferential direction while one of the first end portion and the second end portion of each of the outer shrouds of the stationary vane members is fitted to one of the first band member and the second band member which is placed on a work support surface;

fitting the other of the first band member and the second band member to the other of the first end portion and the second end portion of each of the outer shrouds continuously in the circumferential direction; and fastening the first band member and the second band member to each other by a fastening member so that the outer shrouds of the stationary vane members are connected to each other and the fastening member penetrates through the first band member, one of the outer shrouds, and the second band member in the main axial direction.

12. The method of producing the stationary vane unit of the rotary machine according to claim 11, wherein, in the preparing step, one of the first end portion and the second end portion of the one of the outer shrouds of the stationary vane members is provided with a concave portion, and one of the first band member and the second band member is provided with a convex portion which includes a base portion extending in the circumferential direction and formed in a flat shape and a protruding portion protruding in a direction perpendicular to the circumferential direction, the protruding portion including a reference surface extending in the circumferential direction, and wherein, in the fastening step, the convex portion of the one of the first band member and the second band member is fitted to the concave portion of the one of the first end portion and the second end portion of the one of the outer shrouds of the stationary vane members, and the other of the first end portion and the second end portion of the one of the outer shrouds of the stationary vane members is fastened to the reference surface of the one of the first band member and the second band member by the fastening member while being pressed against the reference surface.

13. The method of producing the stationary vane unit of the rotary machine according to claim 11, wherein a band cutting margin is provided in advance in at least one of the first band member and the second band member, and wherein the band cutting margin is cut so as to adjust a size thereof after the fastening step.

14. The method of producing the stationary vane unit of the rotary machine according to claim 13, wherein a shroud cutting margin is provided in advance in one of the outer shrouds of the stationary vane members so as to be continuous with the band cutting margin, and wherein the shroud cutting margin is cut so as to adjust a size thereof together with the band cutting margin after the fastening step.

15. The method of producing the stationary vane unit of the rotary machine according to claim 11, wherein in the fitting step, at least one of the first band member and the second band member is buried in one of the outer shrouds of the stationary vane members, and wherein after the fastening step, the one of the first band member and the second band member buried in the one of the outer shrouds is plastically deformed toward the one of the outer shrouds, so that a gap between the at least one of the first band member and the second band member buried in the one of the outer shrouds and the one of the outer shrouds is filled.

16. The method of producing the stationary vane unit of the rotary machine according to claim 11, wherein the fastening member is a fastening bolt.

17. The method of producing the stationary vane unit of the rotary machine according to claim 16, wherein an axial length of the fastening bolt is less than or equal to an axial thickness of the one of the outer shrouds.

18. A method of connecting a stationary vane unit of the rotary machine in which a plurality of stationary vane members is arranged around a central axis and outer shrouds formed in outer peripheries of the stationary vane members are continuous in a circumferential direction so as to be connected to each other, the method comprising:

providing a first band member extending in the circumferential direction in the circumferentially continuous outer shrouds of the plurality of stationary vane members from a first side in a main axial direction in which the central axis extends so as to be accommodated in a first groove formed on the first side of the outer shrouds;

providing a second band member extending in the circumferential direction from a second side in the main axial direction so as to be accommodated in a second groove formed on the second side of the outer shrouds; and fastening the first band member and the second band member to each other by a fastening member so that the outer shrouds of the plurality of stationary vane members are connected to each other and the fastening member penetrates through the first band member, one of the outer shrouds, and the second band member in the main axial direction.

19. The method of connecting the stationary vane unit of the rotary machine according to claim 18, wherein the fastening member is a fastening bolt.

20. The method of connecting the stationary vane unit of the rotary machine according to claim 19, wherein an axial length of the fastening bolt is less than or equal to an axial thickness of the one of the outer shrouds.

* * * * *